US006495502B2

(12) United States Patent
Bijl et al.

(10) Patent No.: US 6,495,502 B2
(45) **Date of Patent: *Dec. 17, 2002**

(54) BLEACHING COMPOSITION FOR DRY CLEANING CONTAINING TRANSITION METAL BLEACH CATALYST

(75) Inventors: Dirk Johannes Bijl, Vlaardingen (NL); Ronald Hage, Vlaardingen (NL); Jan Kevelam, Vlaardingen (NL); Jean Hypolites Koek, Vlaardingen (NL); Dennis Stephen Murphy, Edgewater, NJ (US); Irene Erica Smit, Vlaardingen (NL); Johannes J. Verhagen, Vlaardingen (NL); Pieter van der Vlist, Vlaardingen (NL)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 108 days.

This patent is subject to a terminal disclaimer.

(21) Appl. No.: 09/741,394

(22) Filed: Dec. 20, 2000

(65) Prior Publication Data

US 2001/0009271 A1 Jul. 26, 2001

(30) Foreign Application Priority Data

Dec. 23, 1999 (EP) ..... 99204516

(51) Int. Cl.[7] ..... C11D 3/26; C11D 3/39; C11D 3/395; C11D 3/43; C11D 3/20

(52) U.S. Cl. ..... 510/286; 510/303; 510/304; 510/310; 510/311; 510/372; 510/376; 510/466; 510/499; 510/500; 510/506; 8/142

(58) Field of Search ..... 510/286, 303, 510/304, 311, 310, 340, 341, 350, 356, 466, 499, 500, 506, 372, 376; 8/111, 142

(56) References Cited

U.S. PATENT DOCUMENTS

| | | | | | |
|---|---|---|---|---|---|
| 5,431,843 | A | * | 7/1995 | Mitchell et al. | 252/186.38 |
| 5,486,212 | A | * | 1/1996 | Mitchell et al. | 8/142 |
| 5,683,473 | A | | 11/1997 | Jureller et al. | 8/142 |
| 5,792,218 | A | * | 8/1998 | Alvarez et al. | 8/111 |

FOREIGN PATENT DOCUMENTS

| | | |
|---|---|---|
| DE | 39 06 735 | 3/1989 |
| EP | 0 408 131 | 1/1991 |
| EP | 0 530 949 | 3/1993 |
| WO | 94/01227 | 1/1994 |
| WO | 97/48787 | 12/1997 |
| WO | 98/23532 | 6/1998 |
| WO | 98/39405 | 9/1998 |

* cited by examiner

*Primary Examiner*—Gregory Delcotto
(74) *Attorney, Agent, or Firm*—Milton L. Honig

(57) ABSTRACT

A bleaching composition is provided for effective bleaching with a bleach catalyst at low temperatures. The bleaching composition comprises of a) from 0.05 microM to 50 mM of an organic substance which forms a complex with a transition metal;

b) a source of active oxygen corresponding to 0.05 to 100 mM of active oxygen; and c) an effective amount of liquid carbon dioxide, preferably held at 25° C. or less.

34 Claims, No Drawings

BLEACHING COMPOSITION FOR DRY CLEANING CONTAINING TRANSITION METAL BLEACH CATALYST

FIELD OF THE INVENTION

The present invention relates to the field of bleaching compositions, in particular to a bleaching composition comprising bleach catalysts suitable for use at low temperatures, e.g. less than 25° C. In addition the present invention relates to a method of preparing a bleaching composition and method of bleaching, especially textile articles.

BACKGROUND OF THE INVENTION

Peroxygen bleaches are well known for their ability to remove stains from substrates. Traditionally, the substrate is subjected to hydrogen peroxide, or to substances which can generate hydrogen peroxide radicals, such as inorganic or organic peroxides. Generally, these compositions must be activated. One method of activation is to employ wash temperatures of 60° C. or higher. However, these high temperatures often lead to inefficient cleaning, and can also cause premature damage to the substrate.

A preferred approach is to activate these compositions by generating hydrogen peroxide in the presence of organic precursor compounds, also called bleach activators. These compositions are employed for many commercial laundry powders. For example, various European systems are based on tetra acetyl ethylenediamine (TAED) as the organic precursor coupled with sodium perborate or sodium percarbonate, whereas in the United States laundry bleach products are typically based on sodium nonanoyl oxy benzene sulphonate (SNOBS) as the organic precursor coupled with sodium perborate.

Precursor systems are generally effective but still exhibit several disadvantages. For example, organic precursors are moderately sophisticated molecules requiring multi-step manufacturing processes resulting in high capital costs. Also, precursor systems have large formulation space requirements so that a significant proportion of a laundry powder must be devoted to the bleach components, leaving less room for other active ingredients and complicating the development of concentrated powders. Moreover, precursor systems do not bleach very efficiently in countries where consumers have wash habits entailing low dosage, short wash times, low temperatures and low wash liquor to substrate ratios.

Alternatively, or additionally, hydrogen peroxide and peroxy systems can be activated by bleach catalysts, such as by complexes of iron and the ligand N4Py (i.e. N,N-bis (pyridin-2-yl-methyl)-bis(pyridin-2-yl)methylamine) disclosed in WO95/34628, or the ligand Tpen (i.e. N,N,N',N'-tetra(pyridin-2-yl-methyl)ethylenediamine) disclosed in WO97/48787. EP-A-408 131, EP-A-384503, EP-A-458 398, U.S. Pat. No. 5,194,416, WO 96/06157 and WO 98/39405 disclose catalyst wherein the organic part has a macrocyclic structure. Obviously, being catalysts, these bleach catalysts remain active and are not utilised in the reaction like precursors. Therefore, bleach catalysts have the advantage that little formulation space is required as the catalysts are used in minute amounts.

EP-A-909 809 discloses the use of iron catalysts; EP-A-458 397, EP-A-458 398, the use of manganese catalysts; EP-A-408 131 and EP-A-272 030 the use of cobalt catalysts—all for bleaching in combination with a source of peroxide or peroxy acid. All these documents describe bleaching in conventional bleaching compositions comprising aqueous wash liquor.

However, relatively high temperatures are usually employed to get effective bleaching action with bleach catalysts. A drawback of the use of these high temperatures is that the dyes in garments will be damaged more at increasing temperatures (see e.g. M. E. Burns, G. S. Miracle, A. D. Wiley, Surf. Sci. Series, 1998, page 165–203). Another drawback is that certain fabric types, such as wool, are known to undergo dimensional changes at elevated temperatures. Thus, there is a continuing need for bleach compositions comprising bleach catalysts that are effective at low temperatures.

Surprisingly we have now found it is possible to obtain effective bleaching using bleach catalysts at low temperatures, provided that the bleaching occurs in a particular bleaching composition wherein compared to conventional bleaching compositions the water is replaced by liquid carbon dioxide.

U.S. Pat. No. 5,431,843 and WO-98/23532 describe the use of organic peracid precursors along with a source of hydrogen peroxide for use in condensed fluid medium at 20° C. for bleaching of stained garments. At temperatures as high as 80° C. iron metalloporphyrin catalyst has been shown to oxidise cyclohexene in supercritical carbon dioxide (E. R. Birnbaum, et al. J. Mol. Catal. A, 139, 11–24 (1999). However, no where in the art is it taught to bleach with bleach catalysts in liquid carbon dioxide at low temperatures.

SUMMARY OF THE INVENTION

Accordingly, the inventive bleaching composition for low temperature bleaching comprises of a) from 0.05 microM to 50 mM of an organic substance which forms a complex with a transition metal, the complex catalysing bleaching of a substrate with active oxygen;
b) a source of active oxygen corresponding to 0.05 to 100 microM of active oxygen; and
c) an effective amount of liquid carbon dioxide, preferably held at 25° C. or less, more preferably at 20° C. or less, more preferably at 18° C. or less, most preferably at 16° C. or less.

In addition, the present invention encompasses a bleaching method comprising the steps of a) loading articles in a pressurisable vessel; and
b) contacting the items with a composition according the invention.

Furthermore, the present invention encompasses a method of preparing a bleaching composition according to the invention comprising the step dissolving or dispersing the organic substance in a compatible solvent prior to mixing the organic substance with the carbon dioxide.

DETAILED DESCRIPTION OF THE INVENTION

The present invention provides a bleaching composition which provides effective bleaching at very low temperatures. The bleaching composition is defined as the composition wherein the actual bleaching occurs analogous to a wash liquor. In practice this bleaching composition may be prepared by adding a bleaching product to the carbon dioxide analogous to adding a detergent product to the wash liquor.

The bleaching composition may be used to bleach and/or clean any suitable article. The items to be cleaned should be compatible with the liquid carbon dioxide. Preferably, the items include garments and domestic articles with hard surfaces. The bleaching composition is especially useful to clean garments with bleachable stains.

For purposes of the invention, the following definitions are used:

"The bleaching composition" describes the total of the liquid carbon dioxide, the bleach catalyst, the source of active oxygen, the modifier if present and optionally other additives.

"Additives" are compounds to enhance the bleaching and/or cleaning effect of the bleaching composition such as surfactants, whiteners, softners, enzymes, perfume and antistat.

"Liquid carbon dioxide" means carbon dioxide which is placed at temperatures of about 30° C. or less.

"Supercritical fluid carbon dioxide" means carbon dioxide which is at or above the critical temperature of 31° C. and a critical pressure of 7.2 Mpa (71 atmospheres) and which cannot be condensed into a liquid phase despite the addition of further pressure.

The term "densified carbon dioxide" encompasses both liquid and supercritical fluid carbon dioxide.

It is noted that other densified molecules having supercritical properties may also be employed alone or in mixture. These molecules include methane, ethane, propane, ammonia, butane, n-pentane, n-hexane, cyclohexane, n-heptane, ethylene, propylene, methanol, ethanol, isopropanol, benzene, toluene, p-xylene, sulfur dioxide, chlorotrifluoromethane, xenon trichlorofluoromethane, perfluoropropane, chlorodifluoromethane, sulfur hexafluoride and nitrous oxide.

GENERIC GROUP DEFINITION

Throughout the description and claims generic groups have been used, for example alkyl, alkoxy, aryl. Unless otherwise specified the following are preferred group restrictions that may be applied to generic groups found within compounds disclosed herein:

| | |
|---|---|
| alkyl: | linear and branched C1–C8-alkyl, |
| alkenyl: | C2–C6-alkenyl, |
| cycloalkyl: | C3–C8-cycloalkyl, |
| alkoxy: | C1–C6-alkoxy, |

alkylene: selected from the group consisting of: methylene; 1,1-ethylene; 1,2-ethylene; 1,1-propylidene; 1,2-propylene; 1,3-propylene; 2,2-propylidene; butan-2-ol-1,4-diyl; propan-2-ol-1,3-diyl; 1,4-butylene; cyclohexane-1,1-diyl; cyclohexan-1,2-diyl; cyclohexan-1,3-diyl; cyclohexan-1,4-diyl; cyclopentane-1,1-diyl; cyclopentan-1,2-diyl; and cyclopentan-1,3-diyl, aryl: selected from homoaromatic compounds having a molecular weight under 300, arylene: selected from the group consisting of: 1,2-phenylene; 1,3-phenylene; 1,4-phenylene; 1,2-naphtalenylene; 1,3-naphtalenylene; 1,4-naphtalenylene; 2,3-naphtalenylene; 1-hydroxy-2,3-phenylene; 1-hydroxy-2,4-phenylene; 1-hydroxy-2,5-phenylene; and 1-hydroxy-2,6-phenylene, heteroaryl: selected from the group consisting of: pyridinyl; pyrimidinyl; pyrazinyl; triazolyl; pyridazinyl; 1,3,5-triazinyl; quinolinyl; isoquinolinyl; quinoxalinyl; imidazolyl; pyrazolyl; benzimidazolyl; thiazolyl; oxazolidinyl; pyrrolyl; carbazolyl; indolyl; and isoindolyl, wherein the heteroaryl may be connected to the compound via any atom in the ring of the selected heteroaryl, heteroarylene: selected from the group consisting of: pyridindiyl; quinolindiyl; pyrazodiyl; pyrazoldiyl; triazolediyl; pyrazindiyl; and imidazolediyl, wherein the heteroarylene acts as a bridge in the compound via any atom in the ring of the selected heteroarylene, more specifically preferred are: pyridin-2,3-diyl; pyridin-2,4-diyl; pyridin-2,5-diyl; pyridin-2,6-diyl; pyridin-3,4-diyl; pyridin-3,5-diyl; quinolin-2,3-diyl; quinolin-2,4-diyl; quinolin-2,8-diyl; isoquinolin-1,3-diyl; isoquinolin-1,4-diyl; pyrazol-1,3-diyl; pyrazol-3,5-diyl; triazole-3,5-diyl; triazole-1,3-diyl; pyrazin-2,5-diyl; and imidazole-2,4-diyl, a —C1–C6-heterocycloalkyl, wherein the heterocycloalkyl of the —C1–C6-heterocycloalkyl is selected from the group consisting of: piperidinyl; piperidine; 1,4-piperazine, tetrahydrothiophene; tetrahydrofuran; 1,4,7-triazacyclononane; 1,4,8,11-tetraazacyclotetradecane; 1,4,7,10,13-pentaazacyclopentadecane; 1,4-diaza-7-thiacyclononane; 1,4-diaza-7-oxa-cyclononane; 1,4,7,10-tetraazacyclododecane; 1,4-dioxane; 1,4,7-trithiacyclononane; pyrrolidine; and tetrahydropyran, wherein the heterocycloalkyl may be connected to the —C1–C6-alkyl via any atom in the ring of the selected heterocycloalkyl, heterocycloalkylene: selected from the group consisting of: piperidin-1,2-ylene; piperidin-2,6-ylene; piperidin-4,4-ylidene; 1,4-piperazin-1,4-ylene; 1,4-piperazin-2,3-ylene; 1,4-piperazin-2,5-ylene; 1,4-piperazin-2,6-ylene; 1,4-piperazin-1,2-ylene; 1,4-piperazin-1,3-ylene; 1,4-piperazin-1,4-ylene; tetrahydrothiophen-2,5-ylene; tetrahydrothiophen-3,4-ylene; tetrahydrothiophen-2,3-ylene; tetrahydrofuran-2,5-ylene; tetrahydrofuran-3,4-ylene; tetrahydrofuran-2,3-ylene; pyrrolidin-2,5-ylene; pyrrolidin-3,4-ylene; pyrrolidin-2,3-ylene; pyrrolidin-1,2-ylene; pyrrolidin-1,3-ylene; pyrrolidin-2,2-ylidene; 1,4,7-triazacyclonon-1,4-ylene; 1,4,7-triazacyclonon-2,3-ylene; 1,4,7-triazacyclonon-2,9-ylene; 1,4,7-triazacyclonon-3,8-ylene; 1,4,7-triazacyclonon-2,2-ylidene; 1,4,8,11-tetraazacyclotetradec-1,4-ylene; 1,4,8,11-tetraazacyclotetradec-1,8-ylene; 1,4,8,11-tetraazacyclotetradec-2,3-ylene; 1,4,8,11-tetraazacyclotetradec-2,5-ylene; 1,4,8,11-tetraazacyclotetradec-1,2-ylene; 1,4,8,11-tetraazacyclotetradec-2,2-ylidene; 1,4,7,10-tetraazacyclododec-1,4-ylene; 1,4,7,10-tetraazacyclododec-1,7-ylene; 1,4,7,10-tetraazacyclododec-1,2-ylene; 1,4,7,10-tetraazacyclododec-2,3-ylene; 1,4,7,10-tetraazacyclododec-2,2-ylidene; 1,4,7,10,13-pentaazacyclopentadec-1,4-ylene; 1,4,7,10,13-pentaazacyclopentadec-1,7-ylene; 1,4,7,10,13-pentaazacyclopentadec-2,3-ylene; 1,4,7,10,13-pentaazacyclopentadec-1,2-ylene; 1,4,7,10,13-pentaazacyclopentadec-2,2-ylidene; 1,4-diaza-7-thia-cyclonon-1,4-ylene; 1,4-diaza-7-thia-cyclonon-1,2-ylene; 1,4-diaza-7-thia-cyclonon-2,3-ylene; 1,4-diaza-7-thia-cyclonon-6,8-ylene; 1,4-diaza-7-thia-cyclonon-2,2-ylidene; 1,4-diaza-7-oxa-cyclonon-1,4-ylene; 1,4-diaza-7-oxa-cyclonon-1,2-ylene; 1,4-diaza-7-oxa-cyclonon-2,3-ylene; 1,4-diaza-7-oxa-cyclonon-6,8-ylene; 1,4-diaza-7-oxa-cyclonon-2,2-ylidene; 1,4-dioxan-2,3-ylene; 1,4-dioxan-2,6-ylene; 1,4-dioxan-2,2-ylidene; tetrahydropyran-2,3-ylene; tetrahydropyran-2,6-ylene; tetrahydropyran-2,5-ylene; tetrahydropyran-2,2-ylidene; 1,4,7-trithia-cyclonon-2,3-ylene; 1,4,7-trithia-cyclonon-2,9-ylene; and 1,4,7-trithia-cyclonon-2,2-ylidene, heterocycloalkyl: selected from the group consisting of: pyrrolinyl; pyrrolidinyl; morpholinyl; piperidinyl; piperazinyl; hexamethylene imine; 1,4-piperazinyl; tetrahydrothiophenyl; tetrahydrofuranyl; 1,4,7-triazacyclononanyl; 1,4,8,11-tetraazacyclotetradecanyl; 1,4,7,10,13-pentaazacyclopentadecanyl; 1,4-diaza-7-thiacyclononanyl; 1,4-diaza-7-oxa-cyclononanyl; 1,4,7,10-tetraazacyclododecanyl; 1,4-dioxanyl; 1,4,7-trithiacyclononanyl; tetrahydropyranyl; and oxazolidinyl, wherein the heterocycloalkyl may be connected to the compound via any atom in the ring of the selected heterocycloalkyl, amine: the group —$N(R)_2$ wherein each R is independently selected from: hydrogen; C1–C6-alkyl; C1–C6-alkyl-C6H5; and phenyl, wherein when both R are C1–C6-alkyl both R together may form an —NC3 to an —NC5 heterocyclic ring with any remaining alkyl chain forming an alkyl substituent to the heterocyclic ring, halogen: selected from the group consisting of: F; Cl; Br and I, sulphonate: the group —$S(O)_2OR$, wherein R is selected from: hydrogen; C1–C6-alkyl; phenyl; C1–C6-alkyl-C6H5; Li; Na; K; Cs; Mg; and Ca, sulphate: the group —$OS(O)_2OR$, wherein R is selected from: hydrogen; C1–C6-alkyl; phenyl; C1–C6-alkyl-C6H5; Li; Na; K; Cs; Mg; and Ca, sulphone: the group —$S(O)_2R$, wherein R is selected from: hydrogen; C1–C6-alkyl; phenyl; C1–C6-alkyl-C6H5 and amine (to give sulphonamide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, carboxylate derivative: the group —C(O)OR, wherein R is selected from: hydrogen; C1–C6-alkyl; phenyl; C1–C6-alkyl-C6H5; Li; Na; K; Cs; Mg; and Ca, carbonyl derivative: the group —C(O)R, wherein R is selected from: hydrogen; C1–C6-alkyl; phenyl; C1–C6-alkyl-C6H5 and amine (to give amide) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring, phosphonate: the group —$P(O)(OR)_2$, wherein each R is independently selected from: hydrogen; C1–C6-alkyl; phenyl; C1–C6-alkyl-C6H5; Li; Na; K; Cs; Mg; and Ca, phosphate: the group —$OP(O)(OR)_2$, wherein each R is independently selected from: hydrogen; C1–C6-alkyl; phenyl; C1–C6-alkyl-C6H5; Li; Na; K; Cs; Mg; and Ca, phosphine: the group —$P(R)_2$, wherein each R is independently selected from: hydrogen; C1–C6-alkyl; phenyl; and C1–C6-alkyl-C6H5, phosphine oxide: the group —$P(O)R_2$, wherein R is independently selected from: hydrogen; C1–C6-alkyl; phenyl; and C1–C6-alkyl-C6H5; and amine (to give phosphonamidate) selected from the group: —NR'2, wherein each R' is independently selected from: hydrogen; C1–C6-alkyl; C1–C6-alkyl-C6H5; and phenyl, wherein when both R' are C1–C6-alkyl both R' together may form an —NC3 to an —NC5 heterocyclic ring with any remaining alkyl chain forming an alkyl substituent to the heterocyclic ring.

Unless otherwise specified the following are more preferred group restrictions that may be applied to groups found within compounds disclosed herein:

| | |
|---|---|
| alkyl: | linear and branched Cl–C6-alkyl, |
| alkenyl: | C3–C6-alkenyl, |
| cycloalkyl: | C6–C8-cycloalkyl, |
| alkoxy: | C1–C4-alkoxy, |

alkylene: selected from the group consisting of: methylene; 1,2-ethylene; 1,3-propylene; butan-2-ol-1,4-diyl; 1,4-butylene; cyclohexane-1,1-diyl; cyclohexan-1,2-diyl; cyclohexan-1,4-diyl; cyclopentane-1,1-diyl; and cyclopentan-1,2-diyl, aryl: selected from group consisting of: phenyl; biphenyl; naphthalenyl; anthracenyl; and phenanthrenyl, arylene: selected from the group consisting of: 1,2-phenylene; 1,3-phenylene; 1,4-phenylene; 1,2-naphtalenylene; 1,4-naphtalenylene; 2,3-naphtalenylene and 1-hydroxy-2,6-phenylene, heteroaryl: selected from the group consisting of: pyridinyl; pyrimidinyl; quinolinyl; pyrazolyl; triazolyl; isoquinolinyl; imidazolyl; and oxazolidinyl, wherein the heteroaryl may be connected to the compound via any atom in the ring of the selected heteroaryl, heteroarylene: selected from the group consisting of: pyridin-2,3-diyl; pyridin-2,4-diyl; pyridin-2,6-diyl; pyridin-3,5-diyl; quinolin-2,3-diyl; quinolin-2,4-diyl; isoquinolin-1,3-diyl; isoquinolin-1,4-diyl; pyrazol-3,5-diyl; and imidazole-2,4-diyl, heterocycloalkyl: selected from the group consisting of: pyrrolidinyl; morpholinyl; piperidinyl; piperidinyl; 1,4-piperazinyl; tetrahydrofuranyl; 1,4,7-triazacyclononanyl; 1,4,8,11-tetraazacyclotetradecanyl; 1,4,7,10,13-pentaazacyclopentadecanyl; 1,4,7,10-tetraazacyclododecanyl; and piperazinyl, wherein the heterocycloalkyl may be connected to the compound via any atom in the ring of the selected heterocycloalkyl, heterocycloalkylene: selected from the group consisting of: piperidin-2,6-ylene; piperidin-4,4-ylidene; 1,4-piperazin-1,4-ylene; 1,4-piperazin-2,3-ylene; 1,4-piperazin-2,6-ylene; tetrahydrothiophen-2,5-ylene; tetrahydrothiophen-3,4-ylene; tetrahydrofuran-2,5-ylene; tetrahydrofuran-3,4-ylene; pyrrolidin-2,5-ylene; pyrrolidin-2,2-ylidene; 1,4,7-triazacyclonon-1,4-ylene; 1,4,7-triazacyclonon-2,3-ylene; 1,4,7-triazacyclonon-2,2-ylidene; 1,4,8,11-tetraazacyclotetradec-1,4-ylene; 1,4,8,11-tetraazacyclotetradec-1,8-ylene; 1,4,8,11-tetraazacyclotetradec-2,3-ylene; 1,4,8,11-tetraazacyclotetradec-2,2-ylidene; 1,4,7,10-tetraazacyclododec-1,4-ylene; 1,4,7,10-tetraazacyclododec-1,7-ylene; 1,4,7,10-tetraazacyclododec-2,3-ylene; 1,4,7,10-tetraazacyclododec-2,2-ylidene; 1,4,7,10,13-pentaazacyclopentadec-1,4-ylene; 1,4,7,10,13-pentaazacyclopentadec-1,7-ylene; 1,4-diaza-7-thia-cyclonon-1,4-ylene; 1,4-diaza-7-thia-cyclonon-2,3-ylene; 1,4-diaza-7-thia-cyclonon-2,2-ylidene; 1,4-diaza-7-oxa-cyclonon-1,4-ylene; 1,4-diaza-7-oxa-cyclonon-2,3-ylene; 1,4-diaza-7-oxa-cyclonon-2,2-ylidene; 1,4-dioxan-2,6-ylene; 1,4-dioxan-2,2-ylidene; tetrahydropyran-2,6-ylene; tetrahydropyran-2,5-ylene; and tetrahydropyran-2,2-ylidene, a —C1–C6-alkyl-heterocycloalky, wherein the heterocycloalkyl of the —C1–C6-heterocycloalkyl is selected from the group consisting of: piperidinyl; 1,4-piperazinyl; tetrahydrofuranyl; 1,4,7-triazacyclononanyl; 1,4,8,11-tetraazacyclotetradecanyl; 1,4,7,10,13-pentaazacyclopentadecanyl; 1,4,7,10-tetraazacyclododecanyl; and pyrrolidinyl, wherein the heterocycloalkyl may be connected to the —C1–C6-alkyl via any atom in the ring of the selected heterocycloalkyl, amine: the group —$N(R)_2$, wherein each R is independently selected from: hydrogen; C1–C6-alkyl; and benzyl, halogen: selected from the group consisting of: F and Cl, sulphonate: the group —$S(O)_2OR$, wherein R is selected from: hydrogen; C1–C6-alkyl; Na; K; Mg; and Ca, sulphate: the group —$OS(O)_2OR$, wherein R is selected from: hydrogen; C1–C6-alkyl; Na; K; Mg; and Ca, sulphone: the group —$S(O)_2R$, wherein R is selected from: hydrogen; C1–C6-alkyl; benzyl and amine selected from the group: —NR'2, wherein each R' is independently selected from: hydrogen; C1–C6-alkyl; and benzyl, carboxylate derivative: the group —C(O)OR, wherein R is selected from hydrogen; Na; K; Mg; Ca; C1–C6-alkyl; and benzyl, carbonyl derivative: the group: —C(O)R, wherein R is selected from: hydrogen; C1–C6-alkyl; benzyl and amine selected from the group: —NR'2, wherein each R' is independently selected from: hydrogen; C1–C6-alkyl; and benzyl, phosphonate: the group —$P(O)(OR)_2$, wherein each R is independently selected from: hydrogen; C1–C6-alkyl; benzyl; Na; K; Mg; and Ca, phosphate: the group —$OP(O)(OR)_2$, wherein each R is independently selected from: hydrogen; C1–C6-alkyl; benzyl; Na; K; Mg; and Ca, phosphine: the group —$P(R)_2$, wherein each R is independently selected from: hydrogen; C1–C6-alkyl; and benzyl, phosphine oxide: the group —$P(O)R_2$, wherein R is independently selected from: hydrogen; C1–C6-alkyl; benzyl and amine selected from the group: —NR'2, wherein each R' is independently selected from: hydrogen; C1–C6-alkyl; and benzyl.

The Catalyst

The organic substance of the present invention is capable of forming a complex with a metal, whereby the complex is suitable for catalysing bleaching of a substrate with active oxygen. It is preferred that the organic substance comprises a preformed complex of a ligand and a transition metal. In another preferred embodiment, the organic substance may comprise a free ligand that complexes with a transition metal from another source in the bleaching composition. For example the transition metal may already be present in the carbon dioxide, the modifier if present or the substrate. In yet another preferred embodiment, the organic substance may also be included in the form of a composition of a free ligand or a transition metal-substitutable metal-ligand complex, and a source of transition metal, whereby the complex is formed in situ in the medium.

The organic substance forms a complex with one or more transition metals, in the latter case for example as a dinuclear complex. The skilled person may use any suitable transition metal known in the art. Preferred transition metals include for example: manganese in oxidation states II–V, iron I–IV, copper I–III, cobalt I–III, nickel I–III, chromium II–VII, silver I–II, titanium II–IV, tungsten IV–VI, palladium II, ruthenium II–V, vanadium II–V and molybdenum II–VI.

In a preferred embodiment, the organic substance forms a complex of the general formula (A1):

$$[M_aL_kX_n]Y_m$$

in which:

M represents a metal selected from Mn(II)-(III)-(IV)-(V), Cu(I)-(II)-(III), Fe(I)-(II)-(III)-(IV), Co(I)-(II)-(III), Ni(I)-(II)-(III), Cr(II)-(III)-(IV)-(V)-(VI)-(VII), Ti(II)-(III)-(IV), V(II)-(III)-(IV)-(V), Mo(II)-(III)-(IV)-(V)-(VI), W(IV)-(V)-(VI), Pd(II), Ru(II)-(III)-(IV)-(V) and Ag(I)-(II), and preferably selected from Mn(II)-(III)-(IV)-(V), Cu(I)-(II), Fe(II)-(III)-(IV) and Co(I)-(II)-(III);

L represents a ligand as herein defined, or its protonated or deprotonated analogue;

X represents a coordinating species selected from any mono, bi or tri charged anions and any neutral molecules able to coordinate the metal in a mono, bi or tridentate manner, preferably selected from $O^{2-}$, $RBO_2^{2-}$, $RCOO^-$, $RCONR^-$, $OH^-$, $NO_3^-$, $NO_2^-$, NO, CO, $S^{2-}$, $RS^-$, $PO_3^{4-}$, STP-derived anions, $PO_3OR^{3-}$, $H_2O$, $CO_3^{2-}$, $HCO_3^-$, ROH, NRR'R", RCN, $Cl^-$, $Br^-$, $OCN^-$, $SCN^-$, $CN^-$, $N_3^-$, $F^-$, $I^-$, $RO^-$, $ClO_4^-$, $SO_4^{2-}$, $HSO_4^-$, $SO_3^{2-}$ and $RSO_3^-$, and more preferably selected from $O^{2-}$, $RBO_2^{2-}$, $RCOO^-$, $OH^-$, $NO_3^-$, $NO_2^-$, NO, CO, $CN^-$, $S^{2-}$, $RS^-$, $PO_3^{4-}$, $H_2O$, $CO_3^{2-}$, $HCO_3^-$, ROH, NRR'R", $Cl^-$, $Br^-$, $OCN^-$, $SCN^-$, RCN, $N_3^-$, $F^-$, $I^-$, $RO^-$, $ClO_4^-$, $SO_4^{2-}$, $HSO_4^-$, $SO_3^{2-}$ and $RSO_3^-$ (preferably $CF_3SO_3^-$);

Y represents any non-coordinated counter ion, preferably selected from $ClO_4^-$, $BR_4^-$, $[FeCl_4]^-$, $PF_6^-$, $RCOO^-$, $NO_3^-$, $NO_2^-$, $RO^-$, $N^+RR'R''R'''$, $Cl^-$, $Br^-$, $F^-$, $I^-$, $RSO_3^-$, $S_2O_6^{2-}$, $OCN^-$, $SCN^-$, $Li^+$, $Ba^{2+}$, $Na^+$, $Mg^{2+}$, $K^+$, $Ca^{2+}$, $Cs^+$, $PR_4^+$, $RBO_2^{2-}$, $SO_4^{2-}$, $HSO_4^-$, $SO_3^{2-}$, $SbCl_6^-$, $CuCl_4^{2-}$, CN, $PO_4^{3-}$, $HPO_4^{2-}$, $H_2PO_4^-$, STP-derived anions, $CO_3^{2-}$, $HCO_3^-$ and $BF_4^-$, and more preferably selected from $ClO_4^-$, $BR_4^-$, $[FeCl_4]^-$, $PF_6^-$, $RCOO^-$, $NO_3^-$, $NO_2^-$, $RO^-$, $N^+RR'R''R'''$, $Cl^-$, $Br^-$, $F^-$, $I^-$, $RSO_3^-$ (preferably $CF_3SO_3^-$), $S_2O_6^{2-}$, $OCN^-$, $SCN^-$, $Li^+$, $Ba^{2+}$, $Na^+$, $Mg^{2+}$, $K^+$, $Ca^{2+}$, $PR_4^+$, $SO_4^{2-}$, $HSO_4^-$, $SO_3^{2-}$, and $BF_4^-$;

R, R', R", R"' independently represent a group selected from hydrogen, hydroxyl, —OR (wherein R=alkyl, alkenyl, cycloalkyl, heterocycloalkyl, aryl, heteroaryl or carbonyl derivative group), —OAr, alkyl, alkenyl, cycloalkyl, heterocycloalkyl, aryl, heteroaryl and carbonyl derivative groups, each of R, Ar, alkyl, alkenyl, cycloalkyl, heterocycloalkyl, aryl, heteroaryl and carbonyl derivative groups being optionally substituted by one or more functional groups E, or R6 together with R7 and independently R8 together with R9 represent oxygen, wherein E is selected from functional groups containing oxygen, sulphur, phosphorus, nitrogen, selenium, halogens, and any electron donating and/or withdrawing groups, and preferably R, R', R", R"' represent hydrogen, optionally substituted alkyl or optionally substituted aryl, more preferably hydrogen or optionally substituted phenyl, naphthyl or $C_{1-4}$-alkyl;

a represents an integer from 1 to 10, preferably from 1 to 4;

k represents an integer from 1 to 10;

n represents zero or an integer from 1 to 10, preferably from 1 to 4;

m represents zero or an integer from 1 to 20, preferably from 1 to 8.

Preferably, the ligand L is of the general formula (BI):

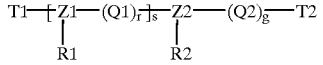

wherein g represents zero or an integer from 1 to 6;

r represents an integer from 1 to 6;

s represents zero or an integer from 1 to 6;

Z1 and Z2 independently represent a heteroatom or a heterocyclic or heteroaromatic ring, Z1 and/or Z2 being optionally substituted by one or more functional groups E as defined below;

Q1 and Q2 independently represent a group of the formula:

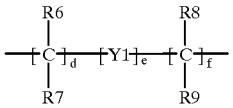

wherein

10>d+e+f>1; d=0–9; e=0–9; f=0–9;

each Y1 is independently selected from —O—, —S—, —SO—, —$SO_2$—, —($G^1$)N—, —($G^1$)($G^2$)N— (wherein $G^1$ and $G^2$ are as defined below), —C(O)—, arylene, alkylene, heteroarylene, —P— and —P(O)—;

if s>1, each —[—Z1(R1)—$(Q1)_r$—]— group is independently defined;

R1, R2, R6, R7, R8, R9 independently represent a group selected from hydrogen, hydroxyl, —OR (wherein R=alkyl, alkenyl, cycloalkyl, heterocycloalkyl, aryl, heteroaryl or carbonyl derivative group), —OAr, alkyl, alkenyl, cycloalkyl, heterocycloalkyl, aryl, heteroaryl and carbonyl derivative groups, each of R, Ar, alkyl, alkenyl, cycloalkyl, heterocycloalkyl, aryl, heteroaryl and carbonyl derivative groups being optionally substituted by one or more functional groups E, or R6 together with R7 and independently R8 together with R9 represent oxygen;

E is selected from functional groups containing oxygen, sulphur, phosphorus, nitrogen, selenium, halogens, and any electron donating and/or withdrawing groups (preferably E is selected from hydroxy, mono- or polycarboxylate derivatives, aryl, heteroaryl, sulphonate, thiol (—RSH), thioethers (—R—S—R'), disulphides (—RSSR'), dithiolenes, mono- or polyphosphonates, mono- or polyphosphates, electron donating groups and electron withdrawing groups, and groups of formulae ($G^1$)($G^2$)N—, ($G^1$)($G^2$)($G^3$)N—, ($G^1$)($G^2$)N—C(O)—, $G^3$O— and $G^3$C(O)—, wherein each of $G^1$, $G^2$ and $G^3$ is independently selected from hydrogen, alkyl, electron donating groups and electron withdrawing groups (in addition to any amongst the foregoing));

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent ═CH—R10, wherein R10 is as defined for R1–R9, or T1 and T2 may together (—T2—T1—) represent a covalent bond linkage when s>1 and g>0;

if Z1 and/or Z2 represent N and T1 and T2 together represent a single bond linkage and R1 and/or R2 are absent, Q1 and/or Q2 may independently represent a group of the formula: ═CH—[—Y1—]$_e$—CH═, optionally any two or more of R1, R2, R6, R7, R8, R9 independently are linked together by a covalent bond;

if Z1 and/or Z2 represents O, then R1 and/or R2 do not exist;

if Z1 and/or Z2 represents S, N, P, B or Si then R1 and/or R2 may be absent;

if Z1 and/or Z2 represents a heteroatom substituted by a functional group E then R1 and/or R2 and/or R4 and/or R5 may be absent.

The groups Z1 and Z2 preferably independently represent an optionally substituted heteroatom selected from N, P, O, S, B and Si or an optionally substituted heterocyclic ring or an optionally substituted heteroaromatic ring selected from pyridine, pyrimidines, pyrazine, pyrazidine, pyrazole, pyrrole, imidazole, benzimidazole, quinoline, isoquinoline, carbazole, triazole, indole, isoindole, furane, thiophene, oxazole and thiazole.

The groups R1–R9 are preferably independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$-$C_{20}$-alkyl and esters and salts thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$–$C_6$-alkyl and $C_0$–$C_{20}$-alkylamide.

One of R1–R9 may be a bridging group which links the ligand moiety to a second ligand moiety of preferably the same general structure. In this case the bridging group may have the formula —$C_{n'}$(R11)(R12)—$(D)_p$—$C_{m'}$(R11)(R12)— bound between the two moieties, wherein p is zero or one, D is selected from a heteroatom or a heteroatom-containing group, or is part of an aromatic or saturated homonuclear and heteronuclear ring, n' is an integer from 1 to 4, m' is an integer from 1 to 4, with the proviso that n'+m'<=4, R11 and R12 are each independently preferably selected from —H, NR13 and OR14, alkyl, aryl, optionally substituted, and R13 and R14 are each independently selected from —H, alkyl, aryl, both optionally substituted. Alternatively, or additionally, two or more of R1–R9 together represent a bridging group linking atoms, preferably hetero atoms, in the same moiety, with the bridging group preferably being alkylene or hydroxy-alkylene or a heteroaryl-containing bridge.

In a first variant according to formula (BI), the groups T1 and T2 together form a single bond linkage and s>1, according to general formula (BII):

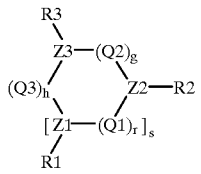

wherein

Z3 independently represents a group as defined for Z1 or Z2; R3 independently represents a group as defined for R1–R9; Q3 independently represents a group as defined for Q1, Q2; h represents zero or an integer from 1 to 6; and s'=s−1.

In a first embodiment of the first variant, in general formula (BII), s'=1, 2 or 3; r=g=h=1; d=2 or 3; e=f=0; R6=R7=H, preferably such that the ligand has a general formula selected from:

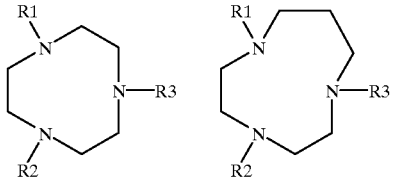

-continued

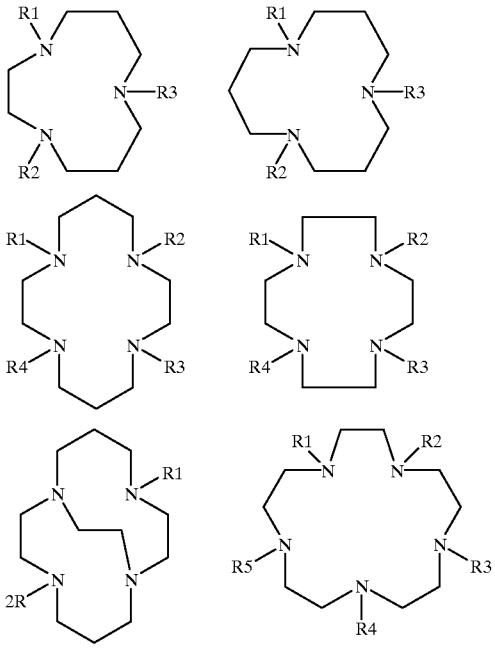

and more preferably selected from:

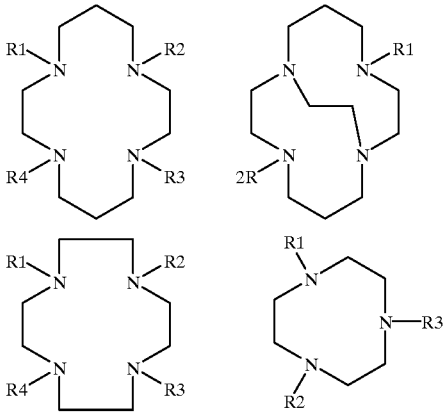

In these preferred examples, R1, $R^2$, $R^3$ and $R^4$ are preferably independently selected from —H, alkyl, aryl, heteroaryl, and/or one of R1–R4 represents a bridging group bound to another moiety of the same general formula and/or two or more of R1–R4 together represent a bridging group linking N atoms in the same moiety, with the bridging group being alkylene or hydroxy-alkylene or a heteroaryl-containing bridge, preferably heteroarylene. More preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

According to this first embodiment, in the complex $[M_aL_kX_n]Y_m$ preferably:

M=Mn(II)–(IV), Cu(I)–(III), Fe(II)–(III), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$ a=1, 2, 3, 4;

n=0, 1, 2, 3, 4, 5, 6, 7, 8, 9;

m=1, 2, 3, 4; and k=1, 2, 4.

In a second embodiment of the first variant, in general formula (BII), s'=2; r=g=h=1; d=f=0; e=1; and each Y1 is independently alkylene or heteroarylene. The ligand preferably has the general formula:

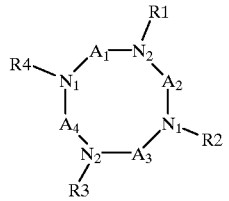

wherein $A_1$, $A_2$, $A_3$, $A_4$ are independently selected from $C_{1-9}$-alkylene or heteroarylene groups; and $N_1$ and $N_2$ independently represent a hetero atom or a heteroarylene group.

In a preferred second embodiment, $N_1$ represents an aliphatic nitrogen, $N_2$ represents a heteroarylene group, R1, R2, R3, R4 each independently represent —H, alkyl, aryl or heteroaryl, and $A_1$, $A_2$, $A_3$, $A_4$ each represent —$CH_2$—.

One of R1–R4 may represent a bridging group bound to another moiety of the same general formula and/or two or more of R1–R4 may together represent a bridging group linking N atoms in the same moiety, with the bridging group being alkylene or hydroxy-alkylene or a heteroaryl-containing bridge. Preferably, R1, R2, R3 and R4 are independently selected from —H, methyl, ethyl, isopropyl, nitrogen-containing heteroaryl, or a bridging group bound to another moiety of the same general formula or linking N atoms in the same moiety with the bridging group being alkylene or hydroxy-alkylene.

Particularly preferably, the ligand has the general formula:

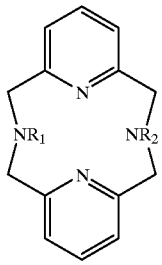

wherein

R1, R2 each independently represent —H, alkyl, aryl or heteroaryl.

According to this second embodiment, in the complex $[M_aL_kX_n]Y_m$ preferably:

M=Fe(II)–(III), Mn(II)–(IV), Cu(II), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4, 5, 6, 7, 8, 9;

m=1, 2, 3, 4; and k=1, 2, 4.

In a third embodiment of the first variant, in general formula (BII), s'=2 and r=g=h=1, according to the general formula:

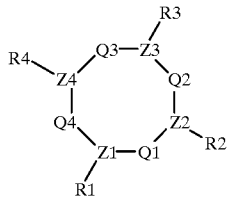

In this third embodiment, preferably each Z1–Z4 represents a heteroaromatic ring; e=f=0; d=1; and R7 is absent, with preferably R1=R2=R3=R4=2,4,6-trimethyl-3-$SO_3Na$-phenyl, 2,6-diCl-3(or 4)—$SO_3Na$-phenyl.

Alternatively, each Z1–Z4 represents N; R1–R4 are absent; both Q1 and Q3 represent =CH—[—Y1—]$_e$—CH=; and both Q2 and Q4 represent —$CH_2$—[—Y1—]$_n$—$CH_2$—.

Thus, preferably the ligand has the general formula:

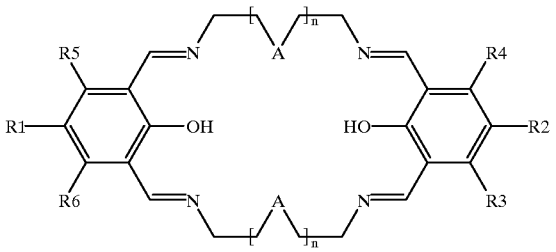

wherein

A represents optionally substituted alkylene optionally interrupted by a heteroatom; and n is zero or an integer from 1 to 5.

Preferably, R1–R6 represent hydrogen, n=1 and A=—$CH_2$—, —CHOH—, —$CH_2N(R)CH_2$— or —$CH_2CH_2N(R)CH_2CH_2$— wherein R represents hydrogen or alkyl, more preferably A=—$CH_2$—, —CHOH— or —$CH_2CH_2NHCH_2CH_2$—.

According to this third embodiment, in the complex $[M_aL_kX_n]Y_m$ preferably:

M=Mn(II)–(IV), Co(II)–(III), Fe(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4, 5, 6, 7, 8, 9;

m=1, 2, 3, 4; and k=1, 2, 4.

In a second variant according to formula (BI), T1 and T2 independently represent groups R4, R5 as defined for R1–R9, according to the general formula (BIII):

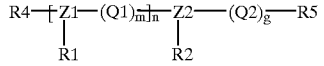

In a first embodiment of the second variant, in general formula (BIII), s=1; r=1; g=0; d=f=1; e=1-4; Y1=—$CH_2$—; and R1 together with R4, and/or R2 together with R5, independently represent =CH—R10, wherein R10 is as defined for R1–R9. In one example, R2 together with R5 represents =CH—R10, with R1 and R4 being two separate groups. Alternatively, both R1 together with R4, and R2 together with R5 may independently represent =CH—R10. Thus, preferred ligands may for example have a structure selected from:

Type 1

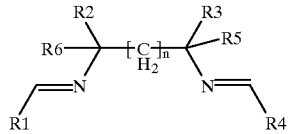

Type 2

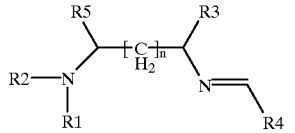

Preferably, the ligand is selected from:

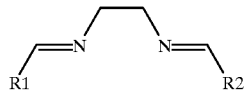

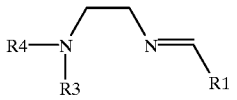

wherein

R1 and R2 are selected from optionally substituted phenols, heteroaryl-$C_0$–$C_{20}$-alkyls, R3 and R4 are selected from —H, alkyl, aryl, optionally substituted phenols, heteroaryl-$C_0$–$C_{20}$-alkyls, alkylaryl, aminoalkyl, alkoxy, more preferably R1 and R2 being selected from optionally substituted phenols, heteroaryl-$C_0$–$C_2$-alkyls, R3 and R4 are selected from —H, alkyl, aryl, optionally substituted phenols, nitrogen-heteroaryl-$C_0$–$C_2$-alkyls.

According to this first embodiment, in the complex $[M_aL_kX_n]Y_m$ preferably:

M=Mn(II)–(IV), Co(II)–(III), Fe(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4, 5, 6, 7, 8, 9;

m=1, 2, 3, 4; and k=1, 2, 4.

In a second embodiment of the second variant, in general formula (BIII), s=1; r=1; g=0; d=f=1; e=1–4; Y1=—C(R')(R"), wherein R' and R" are independently as defined for R1–R9. Preferably, the ligand has the general formula:

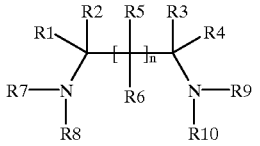

The groups R1, R2, R3, R4, R5 in this formula are preferably —H or $C_0$–$C_{20}$-alkyl, n=0 or 1, R6 is —H, alkyl, —OH or —SH, and R7, R8, R9, R10 are preferably each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

According to this second embodiment, in the complex $[M_aL_kX_n]Y_m$ preferably:

M=Mn(II)–(IV), Fe(II)–(III), Cu(II), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4;

m=0, 1, 2, 3, 4, 5, 6, 7, 8; and k=1, 2, 3, 4.

In a third embodiment of the second variant, in general formula (BIII), s=0; g=1; d=e=0; f=1–4. Preferably, the ligand has the general formula:

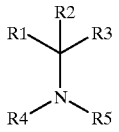

More preferably, the ligand has the general formula:

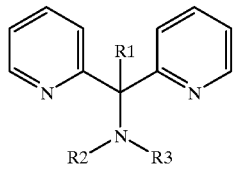

wherein

R1, R2, R3 are as defined for R2, R4, R5.

According to this third embodiment, in the complex $[M_aL_kX_n]Y_m$ preferably:

M=Mn(II)–(IV), Fe(II)–(III), Cu(II), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4;

m=0, 1, 2, 3, 4, 5, 6, 7, 8; and k=1, 2, 3, 4.

In a fourth embodiment of the second variant, the organic substance forms a complex of the general formula (A):

$$[LMX_n]^zY_q$$

in which

M represents iron in the II, III, IV or V oxidation state, manganese in the II, III, IV, VI or VII oxidation state, copper in the I, II or III oxidation state, cobalt in the II, III or IV oxidation state, or chromium in the II–VI oxidation state;

X represents a coordinating species;

n represents zero or an integer in the range from 0 to 3;

z represents the charge of the complex and is an integer which can be positive, zero or negative;

Y represents a counter ion, the type of which is dependent on the charge of the complex;

q=z/[charge Y]; and

L represents a pentadentate ligand of the general formula (B):

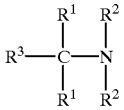

wherein each $R^1$, $R^2$ independently represents —$R^4$—$R^5$, $R^3$ represents hydrogen, optionally substituted alkyl, aryl or arylalkyl, or —$R^4$—$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

The ligand L having the general formula (B), as defined above, is a pentadentate ligand. By 'pentadentate' herein is meant that five hetero atoms can coordinate to the metal M ion in the metal-complex.

In formula (B), one coordinating hetero atom is provided by the nitrogen atom in the methylamine backbone, and preferably one coordinating hetero atom is contained in each of the four $R^1$ and $R^2$ side groups. Preferably, all the coordinating hetero atoms are nitrogen atoms.

The ligand L of formula (B) preferably comprises at least two substituted or unsubstituted heteroaryl groups in the four side groups. The heteroaryl group is preferably a pyridin-2-yl group and, if substituted, preferably a methyl- or ethyl-substituted pyridin-2-yl group. More preferably, the heteroaryl group is an unsubstituted pyridin-2-yl group. Preferably, the heteroaryl group is linked to methylamine, and preferably to the N atom thereof, via a methylene group. Preferably, the ligand L of formula (B) contains at least one optionally substituted amino-alkyl side group, more preferably two amino-ethyl side groups, in particular 2-(N-alkyl) amino-ethyl or 2-(N,N-dialkyl)amino-ethyl.

Thus, in formula (B) preferably $R^1$ represents pyridin-2-yl or $R^2$ represents pyridin-2-yl-methyl. Preferably $R^{2\ or\ R1}$ represents 2-amino-ethyl, 2-(N-(m)ethyl)amino-ethyl or 2-(N,N-di(m)ethyl)amino-ethyl. If substituted, $R^5$ preferably represents 3-methyl pyridin-2-yl. $R^3$ preferably represents hydrogen, benzyl or methyl.

Examples of preferred ligands L of formula (B) in their simplest forms are:

(i) pyridin-2-yl containing ligands such as:

N,N-bis(pyridin-2-yl-methyl)-bis(pyridin-2-yl) methylamine;

N,N-bis(pyrazol-1-yl-methyl)-bis(pyridin-2-yl) methylamine;

N,N-bis(imidazol-2-yl-methyl)-bis(pyridin-2-yl) methylamine;

N,N-bis(1,2,4-triazol-1-yl-methyl)-bis(pyridin-2-yl) methylamine;

N,N-bis(pyridin-2-yl-methyl)-bis(pyrazol-1-yl) methylamine;

N,N-bis(pyridin-2-yl-methyl)-bis(imidazol-2-yl) methylamine;

N,N-bis(pyridin-2-yl-methyl)-bis(1,2,4-triazol-1-yl) methylamine;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-2-phenyl-1-aminoethane;

N,N-bis(pyrazol-1-yl-methyl)-1,1-bis(pyridin-2-yl)-1-aminoethane;

N,N-bis(pyrazol-1-yl-methyl)-1,1-bis(pyridin-2-yl)-2-phenyl-1-aminoethane;

N,N-bis(imidazol-2-yl-methyl)-1,1-bis(pyridin-2-yl)-1-aminoethane;

N,N-bis(imidazol-2-yl-methyl)-1,1-bis(pyridin-2-yl)-2-phenyl-1-aminoethane;

N,N-bis(1,2,4-triazol-1-yl-methyl)-1,1-bis(pyridin-2-yl)-1-aminoethane;

N,N-bis(1,2,4-triazol-1-yl-methyl)-1,1-bis(pyridin-2-yl)-2-phenyl-1-aminoethane;

N,N-bis(pyridin-2-yl-methyl)-1,1-bis(pyrazol-1-yl)-1-aminoethane;

N,N-bis(pyridin-2-yl-methyl)-1,1-bis(pyrazol-1-yl)-2-phenyl-1-aminoethane;

N,N-bis(pyridin-2-yl-methyl)-1,1-bis(imidazol-2-yl)-1-aminoethane;

N,N-bis(pyridin-2-yl-methyl)-1,1-bis(imidazol-2-yl)-2-phenyl-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(1,2,4-triazol-1-yl)-1-aminoethane;

N,N-bis(pyridin-2-yl-methyl)-1,1-bis(pyridin-2-yl)-1-aminoethane;

N,N-bis(pyridin-2-yl-methyl)-1,1-bis(pyridin-2-yl)-1-aminohexane;

N,N-bis(pyridin-2-yl-methyl)-1,1-bis(pyridin-2-yl)-2-phenyl-1-aminoethane;

N,N-bis(pyridin-2-yl-methyl)-1,1-bis(pyridin-2-yl)-2-(4-sulphonic acid-phenyl)-1-aminoethane;

N,N-bis(pyridin-2-yl-methyl)-1,1-bis(pyridin-2-yl)-2-(pyridin-2-yl)-1-aminoethane;

N,N-bis(pyridin-2-yl-methyl)-1,1-bis(pyridin-2-yl)-2-(pyridin-3-yl)-1-aminoethane;

N,N-bis(pyridin-2-yl-methyl)-1,1-bis(pyridin-2-yl)-2-(pyridin-4-yl)-1-aminoethane;

N,N-bis(pyridin-2-yl-methyl)-1,1-bis(pyridin-2-yl)-2-(1-alkyl-pyridinium-4-yl)-1-aminoethane;

N,N-bis(pyridin-2-yl-methyl)-1,1-bis(pyridin-2-yl)-2-(1-alkyl-pyridinium-3-yl)-1-aminoethane;

N,N-bis(pyridin-2-yl-methyl)-1,1-bis(pyridin-2-yl)-2-(1-alkyl-pyridinium-2-yl)-1-aminoethane;

(ii) 2-amino-ethyl containing ligands such as:

N,N-bis(2-(N-alkyl)amino-ethyl)-bis(pyridin-2-yl) methylamine;

N,N-bis(2-(N-alkyl)amino-ethyl)-bis(pyrazol-1-yl) methylamine;

N,N-bis(2-(N-alkyl)amino-ethyl)-bis(imidazol-2-yl) methylamine;

N,N-bis(2-(N-alkyl)amino-ethyl)-bis(1,2,4-triazol-1-yl) methylamine;

N,N-bis(2-(N,N-dialkyl)amino-ethyl)-bis(pyridin-2-yl) methylamine;

N,N-bis(2-(N,N-dialkyl)amino-ethyl)-bis(pyrazol-1-yl) methylamine;

N,N-bis(2-(N,N-dialkyl)amino-ethyl)-bis(imidazol-2-yl) methylamine;

N,N-bis(2-(N,N-dialkyl)amino-ethyl)-bis(1,2,4-triazol-1-yl) methylamine;

N,N-bis(pyridin-2-yl-methyl)-bis(2-amino-ethyl) methylamine;

N,N-bis(pyrazol-1-yl-methyl)-bis(2-amino-ethyl) methylamine;

N,N-bis(imidazol-2-yl-methyl)-bis(2-amino-ethyl) methylamine;

N,N-bis(1,2,4-triazol-1-yl-methyl)-bis(2-amino-ethyl) methylamine.

More preferred ligands are:

N,N-bis(pyridin-2-yl-methyl)-bis(pyridin-2-yl) methylamine, hereafter referred to as N4Py.

N,N-bis(pyridin-2-yl-methyl)-1,1-bis(pyridin-2-yl)-1-aminoethane, hereafter referred to as MeN4Py, N,N-bis(pyridin-2-yl-methyl)-1,1-bis(pyridin-2-yl)-2-phenyl-1-aminoethane, hereafter referred to as BzN4Py.

In an alternative fourth embodiment, the organic substance forms a complex of the general formula (A) including a ligand (B) as defined above, but with the proviso that $R^3$ does not represent hydrogen.

In a fifth embodiment of the second variant, the organic substance forms a complex of the general formula (A) as defined above, but wherein L represents a pentadentate or hexadentate ligand of general formula (C):

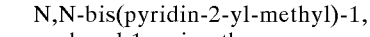

$$R^1R^1N—W—NR^1R^2$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

The ligand L having the general formula (C), as defined above, is a pentadentate ligand or, if $R^1$=$R^2$, can be a hexadentate ligand. As mentioned above, by 'pentadentate' is meant that five hetero atoms can coordinate to the metal M ion in the metal-complex. Similarly, by 'hexadentate' is meant that six hetero atoms can in principle coordinate to the metal M ion. However, in this case it is believed that one of the arms will not be bound in the complex, so that the hexadentate ligand will be penta coordinating.

In the formula (C), two hetero atoms are linked by the bridging group W and one coordinating hetero atom is contained in each of the three $R^1$ groups. Preferably, the coordinating hetero atoms are nitrogen atoms.

The ligand L of formula (C) comprises at least one optionally substituted heteroaryl group in each of the three $R^1$ groups. Preferably, the heteroaryl group is a pyridin-2-yl group, in particular a methyl- or ethyl-substituted pyridin-2-yl group. The heteroaryl group is linked to an N atom in formula (C), preferably via an alkylene group, more preferably a methylene group. Most preferably, the heteroaryl group is a 3-methyl-pyridin-2-yl group linked to an N atom via methylene.

The group $R^2$ in formula (C) is a substituted or unsubstituted alkyl, aryl or arylalkyl group, or a group $R^1$. However, preferably $R^2$ is different from each of the groups $R^1$ in the formula above. Preferably, $R^2$ is methyl, ethyl, benzyl, 2-hydroxyethyl or 2-methoxyethyl. More preferably, $R^2$ is methyl or ethyl.

The bridging group W may be a substituted or unsubstituted alkylene group selected from —$CH_2CH_2$—, —$CH_2CH_2CH_2$—, —$CH_2CH$—$_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$— (wherein —$C_6H_4$—, —$C_6H_{10}$—, —$C_{10}H_6$— can be ortho-, para-, or meta-$C_6H_4$—, —$C_6H_{10}$—, —$C_{10}H_6$—). Preferably, the bridging group W is an ethylene or 1,4-butylene group, more preferably an ethylene group.

Preferably, V represents substituted pyridin-2-yl, especially methyl-substituted or ethyl-substituted pyridin-2-yl, and most preferably V represents 3-methyl pyridin-2-yl.

Examples of preferred ligands of formula (C) in their simplest forms are:

N-methyl-N,N',N'-tris(3-methyl-pyridin-2-ylmethyl) ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine;

N-(2-methoxyethyl)-N,N',N'-tris(3-methyl-pyridin-2-ylmethyl)ethylene-1,2-diamine;

N-methyl-N,N',N'-tris(5-methyl-pyridin-2-ylmethyl) ethylene-1,2-diamine;

N-ethyl-N,N',N'-tris(5-methyl-pyridin-2-ylmethyl)ethylene-1,2-diamine;

N-benzyl-N,N',N'-tris(5-methyl-pyridin-2-ylmethyl) ethylene-1,2-diamine;

N-(2-hydroxyethyl)-N,N',N'-tris(5-methyl-pyridin-2-ylmethyl)ethylene-1,2-diamine;

N-(2-methoxyethyl)-N,N',N'-tris(5-methyl-pyridin-2-ylmethyl)ethylene-1,2-diamine;

N-methyl-N,N',N'-tris(3-ethyl-pyridin-2-ylmethyl)ethylene-1,2-diamine;

N-ethyl-N,N',N'-tris(3-ethyl-pyridin-2-ylmethyl)ethylene-1,2-diamine;

N-benzyl-N,N',N'-tris(3-ethyl-pyridin-2-ylmethyl)ethylene-1,2-diamine;

N-(2-hydroxyethyl)-N,N',N'-tris(3-ethyl-pyridin-2-ylmethyl)ethylene-1,2-diamine;

N-(2-methoxyethyl)-N,N',N'-tris(3-ethyl-pyridin-2-ylmethyl)ethylene-1,2-diamine;

N-methyl-N,N',N'-tris(5-ethyl-pyridin-2-ylmethyl)ethylene-1,2-diamine;

N-ethyl-N,N',N'-tris(5-ethyl-pyridin-2-ylmethyl)ethylene-1,2-diamine;

N-benzyl-N,N',N'-tris(5-ethyl-pyridin-2-ylmethyl)ethylene-1,2-diamine; and

N-(2-methoxyethyl)-N,N',N'-tris(5-ethyl-pyridin-2-ylmethyl)ethylene-1,2-diamine.

More preferred ligands are:

N-methyl-N,N',N'-tris(3-methyl-pyridin-2-ylmethyl) ethylene-1,2-diamine;

N-ethyl-N,N',N'-tris(3-methyl-pyridin-2-ylmethyl)ethylene-1,2-diamine;

N-benzyl-N,N',N'-tris(3-methyl-pyridin-2-ylmethyl) ethylene-1,2-diamine;

N-(2-hydroxyethyl)-N,N',N'-tris(3-methyl-pyridin-2-ylmethyl)ethylene-1,2-diamine; and N-(2-methoxyethyl)-N,N',N'-tris(3-methyl-pyridin-2-ylmethyl)ethylene-1,2-diamine.

The most preferred ligands are:

N-methyl-N,N',N'-tris(3-methyl-pyridin-2-ylmethyl) ethylene-1,2-diamine; and

N-ethyl-N,N',N'-tris(3-methyl-pyridin-2-ylmethyl)ethylene-1,2-diamine.

Preferably, the metal M in formula (A) is Fe or Mn, more preferably Fe.

Preferred coordinating species X in formula (A) may be selected from $R^6OH$, $NR^6_3$, $R^6CN$, $R^6OO^-$, $R^6S^-$, $R^6O^-$, $R^6COO^-$, $OCN^-$, $SCN^-$, $N_3^-$, $CN^-$, $F^-$, $Cl^-$, $Br^-$, $I^-$, $O^{2-}$, $NO_3^-$, $NO_2^-$, $SO_4^{2-}$, $SO_3^{2-}$, $PO_4^{3-}$ and aromatic N donors selected from pyridines, pyrazines, pyrazoles, pyrroles, imidazoles, benzimidazoles, pyrimidines, triazoles and thiazoles, with $R^6$ being selected from hydrogen, optionally substituted alkyl and optionally substituted aryl. X may also be the species $LMO^-$ or $LMOO^-$, wherein M is a transition metal and L is a ligand as defined above. The coordinating species X is preferably selected from $CH_3CN$, $H_2O$, $F^-$, $Cl^-$, $Br^-$, $OOH^-$, $R^6COO^-$, $R^6O^-$, $LMO^-$, and $LMOO^-$ wherein $R^6$ represents hydrogen or optionally substituted phenyl, naphthyl, or $C_1$–$C_4$ alkyl.

The counter ions Y in formula (A) balance the charge z on the complex formed by the ligand L, metal M and coordinating species X. Thus, if the charge z is positive, Y may be an anion such as $R^7COO^-$, $BPh_4^-$, $ClO_4^-$, $BF_4^-$, $PF_6^-$, $R^7SO_3^-$, $R^7SO_4^-$, $SO_4^{2-}$, $NO_3^-$, $F^-$, $Cl^-$, $Br^-$, or $I^-$, with $R^7$ being hydrogen, optionally substituted alkyl or optionally substituted aryl. If z is negative, Y may be a common cation such as an alkali metal, alkaline earth metal or (alkyl) ammonium cation.

Suitable counter ions Y include those which give rise to the formation of storage-stable solids. Preferred counter ions for the preferred metal complexes are selected from $R^7COO^-$, $ClO_4^-$, $BF_4^-$, $PF_6^-$, $R^7SO_3^-$ (in particular $CF_3SO_3^-$), $R^7SO_4^-$, $SO_4^{2-}$, $NO_3^-$, $F^-$, $Cl^-$, $Br^-$, and $I^-$, wherein $R^7$ represents hydrogen or optionally substituted phenyl, naphthyl or $C_1$–$C_4$ alkyl.

It will be appreciated that the complex (A) or more in general (A1) can be formed by any appropriate means, including in situ formation whereby precursors of the complex are transformed into the active complex of general formula (A) under conditions of storage or use. Preferably, the complex is formed as a well-defined complex or in a solvent mixture comprising a salt of the metal M and the ligand L or ligand L-generating species. Alternatively, the catalyst may be formed in situ from suitable precursors for the complex, for example in a solution or dispersion containing the precursor materials. In one such example, the active catalyst may be formed in situ in a mixture comprising a salt of the metal M and the ligand L, or a ligand L-generating species, in a suitable solvent. Thus, for example, if M is iron, an iron salt such as $FeSO_4$ can be mixed in solution with the ligand L, or a ligand L-generating species, to form the active complex. In another such example, the ligand L, or a ligand L-generating species, can be mixed with metal M ions present in the substrate or wash liquor to form the active catalyst in situ. Suitable ligand L-generating species include metal-free compounds or metal coordination complexes that comprise the ligand L and can be substituted by metal M ions to form the active complex according the formula (A).

Therefore, in alternative fourth and fifth embodiments, the organic substance is a compound of the general formula (D):

$$[\{M'_aL\}_bX_c]^zY_q$$

in which

M' represents hydrogen or a metal selected from Ti, V, Co, Zn, Mg, Ca, Sr, Ba, Na, K, and Li;

X represents a coordinating species;

a represents an integer in the range from 1 to 5;

b represents an integer in the range from 1 to 4;

c represents zero or an integer in the range from 0 to 5;

z represents the charge of the compound and is an integer which can be positive, zero or negative;

Y represents a counter ion, the type of which is dependent on the charge of the compound;

q=z/[charge Y]; and

L represents a pentadentate ligand of general formula (B) or (C) as defined above.

In a fourth embodiment of the first variant, the organic substance comprises a macrocyclic ligand of formula (E):

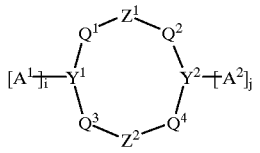

wherein $Z^1$ and $Z^2$ are independently selected from monocyclic or polycyclic aromatic ring structures optionally containing one or more heteroatoms, each aromatic ring structure being substituted by one or more substituents;

$Y^1$ and $Y^2$ are independently selected from C, N, O, Si, P and S atoms;

$A^1$ and $A^2$ are independently selected from hydrogen, alkyl, alkenyl and cycloalkyl (each of alkyl, alkenyl and cycloalkyl) being optionally substituted by one or more groups selected from hydroxy, aryl, heteroaryl, sulphonate, phosphate, electron donating groups and electron withdrawing groups, and groups of formulae $(G^1)(G^2)N$—, $G^3OC(O)$—, $G^3O$— and $G^3C(O)$—, wherein each of $G^1$, $G^2$ and $G^3$ is independently selected from hydrogen and alkyl, and electron donating and/or withdrawing groups (in addition to any amongst the foregoing);

i and j are selected from 0, 1 and 2 to complete the valency of the groups $Y^1$ and $Y^2$;

each of $Q^1$–$Q^4$ is independently selected from groups of formula

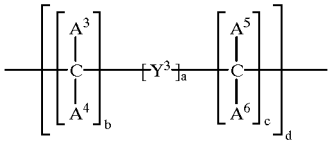

wherein

10>a+b+c>2 and d>=1;

each $Y^3$ is independently selected from —O—, —S—, —SO—, —$SO^2$—, —$(G^1)N$— (wherein $G^1$ is hereinbefore defined), —C(O)—, arylene, heteroarylene, —P— and —P(O)—;

each of $A^3$–$A^6$ is independently selected from the groups hereinbefore defined for $A^1$ and $A^2$; and wherein any two or more of $A^1$–$A^6$ together form a bridging group, provided that if $A^1$ and $A^2$ are linked without simultaneous linking also to any of $A^3$–$A^6$, then the bridging group linking $A^1$ and $A^2$ must contain at least one carbonyl group.

In the ligands of formula (E), unless specifically stated to the contrary, all alkyl, hydroxyalkyl alkoxy, and alkenyl groups preferably have from 1 to 6, more preferably from 1 to 4 carbon atoms.

Moreover, preferred electron donating groups include alkyl (e.g. methyl), alkoxy (e.g. methoxy), phenoxy, and unsubstituted, monosubstituted and disubstituted amine groups. Preferred electron withdrawing groups include nitro, carboxy, sulphonyl and halo groups.

The ligands of formula (E) may be used in the form of complexes with an appropriate metal or, in some cases, in non-complexed form. In the non-complexed form, they rely upon complexing with a metal supplied in the form of a separate ingredient in the composition, specifically provided for supplying that metal, or upon complexing with a metal found as a trace element in tap water. However, where the ligand alone or in complex form carries a (positive) charge, a counter anion is necessary. The ligand or complex may be formed as a neutral species but it is often advantageous, for reasons of stability or ease of synthesis, to have a charged species with appropriate anion.

Therefore, in an alternative fourth embodiment, the ligand of formula (E) is ion-paired with a counter ion, which ion-pairing is denoted by formula (F):

$$[H_xL]^zY_q$$

wherein

H is an hydrogen atom;

Y is a counter anion, the type of which is dependent on the charge of the complex;

x is an integer such that one or more nitrogen atoms in L is protonated;

z represents the charge of the complex and is an integer which can be positive or zero;

q=z/[charge of Y]; and

L is a ligand of formula (E) as defined above.

In a further alternative fourth embodiment, the organic substance forms a metal complex of formula (G) based on the ion pairing of formula (F) thus:

$$[M_xL]^zY_q$$

wherein

L, Y, x, z and q are as defined for formula (F) above and M is a metal selected from manganese in oxidation states II–V, iron II–V, copper I–III, cobalt I–III, nickel I–III, chromium II–VI, tungsten IV–VI, palladium V, ruthenium II–IV, vanadium III–IV and molybdenum IV–VI.

Especially preferred are the complexes of formula (G) wherein M represents manganese, cobalt, iron or copper.

In a preferred fourth embodiment, the organic substance forms a complex of the formula (H):

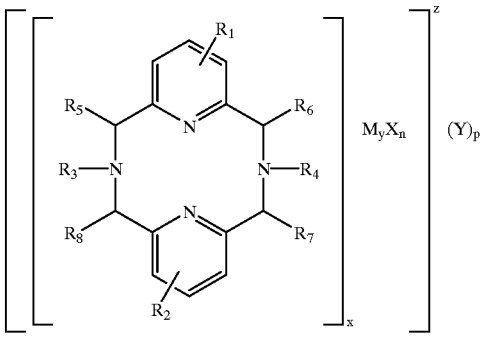

wherein

M represents an iron atom in oxidation state II or III, a manganese atom in oxidation state II, III, IV or V, a copper atom in oxidation state I, II or III or a cobalt atom in oxidation state II, III or IV, X is a group which is either a bridge or is not a bridge between iron atoms, Y is a counter ion, x and y being >=1, 0=<n=<3, and z being the charge of the metal complex, and p=z/charge of Y; $R_1$ and $R_2$ being independently one or more ring substituents selected from hydrogen and electron donating and withdrawing groups, $R_3$ to $R_8$ being independently hydrogen, alkyl, hydroxyalkyl, alkenyl or variants of any of these when substituted by one or more electron donating or withdrawing groups.

For the avoidance of doubt, "=<" means "less than or equal to" and ">=" means "greater than or equal to".

Preferably, in the complex of formula (H), M represents an iron atom in oxidation state II or III or a manganese atom in oxidation state II, III, IV, or V. Preferably the oxidation state of M is III.

When M is iron, preferably the complex of formula (H) is in the form of a salt of iron (in oxidised state) dihalo-2,11-diazo[3.3](2,6)pyridinophane, dihalo-4-methoxy-2,11-diazo [3.3](2,6)pyridinophane and mixtures thereof, especially in the form of the chloride salt.

When M is manganese, preferably the complex of formula (H) is in the form of a salt of manganese (in oxidised state) N,N'-dimethyl-2,11-diazo[3.3](2,6)pyridinophane, especially in the form of the monohexafluorophosphate salt.

Preferably, X is selected from $H_2O$, $OH^-$, $O^{2-}$, $SH^-$, $S^{2-}$, $SO_4^{2-}$, $NR_9R_{10}^-$, $RCOO^-$, $NR_9R_{10}R_{11}$, $Cl^-$, $Br^-$, $F^-$, $N_3^-$ and combinations thereof, wherein $R_9$, $R_{10}$ and $R_{11}$ are independently selected from —H, $C_{1-4}$ alkyl and aryl optionally substituted by one or more electron withdrawing and/or donating groups. More preferably, X is a halogen, especially a fluoride ion.

In the formulae (F), (G) and (H), the anionic counter ion equivalent Y is preferably selected from $Cl^-$, $Br^-$, $I^-$, $NO_3^-$, $ClO_4^-$, $SCN^-$, $PF_6$—, $RSO_3^-$, $RSO_4^-$, $CF_3SO_3^-$, $BPh_4^-$, and $OAc^-$. A cationic counter ion equivalent is preferably absent.

In formula (H), $R_1$ and $R_2$ are preferably both hydrogen. $R_3$ and $R_4$ are preferably $C_{1-4}$ alkyl, especially methyl. $R_5$–$R_8$ are each preferably hydrogen.

According to the values of x and y, the aforementioned preferred iron or manganese catalysts of formula (H) may be in the form of a monomer, dimer or oligomer. Without being bound by any theory, it has been conjectured that in the raw material or detergent composition state, the catalyst exists mainly or solely in monomer form but could be converted to dimer, or even oligomeric form, in the wash solution.

In a yet a third variant, the ligand forms a complex of the general formula (A1) whereby L represents a ligand of the general formula, or its protonated or deprotonated analogue:

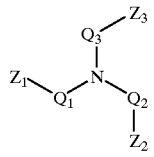

wherein $Z_1$, $Z_2$ and $Z_3$ independently represent a co-ordinating group selected from carboxylate, amido, —NH—C(NH) $NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 Q2 and Q3 independently represent a group of the formula:

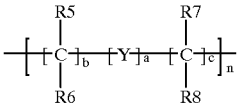

wherein

5≧a+b+c≧1; a=0–5; b=0–5; c=0–5; n=1 or 2;

Preferably, $Q_1$, $Q_2$ and $Q_3$ are defined such that a=b=0, c=1 or 2, and n=1

Preferably, $Q_1$, $Q_2$ and $Q_3$ independently represent a group selected from —$CH_2$— and —$CH_2CH_2$—.

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I; and E independently represents a functional group selected from —F, —Cl, —Br, —I, —OH, —OR', $NH_2$, —NHR', —$N(R')_2$, —$N(R')_3^+$, —C(O)R', —OC(O)R', —COOH, —$COO^-$ ($NA^+$, $K^+$), —COOR', —C(O)$NH_2$, —C(O)NHR', —C(O)$N(R')_2$, heteroaryl, —R', —SR', —SH, —$P(R')_2$, —$P(O)(R')_2$—$P(O)(OH)_2$, —$P(O)(OR')_2$, —$NO_2$, —$SO_3H$, —$SO_3^-$ ($NA^+$, $K^+$) —$S(O)_2R'$, —NHC(O)R', and —N(R') C(O)R', wherein R' represents cycloalkyl, aryl, arylalkyl, or alkyl optionally substituted by —F, —Cl, —Br, —I, —$NH_3^+$, —$SO_3H$, —$SO_3^-$ ($Na^+$,$K^+$), —COOH, —$COO^-$ ($Na^+$,$K^+$), —P(O)$(OH)_2$, or —P(O) ($O^-$($Na^+$,$K^+$))$_2$.

Preferred are the ligands as defined above with $Z_1$, $Z_2$ and Z independently represent a coordinating group selected from optionally substituted pyridin-2-yl, optionally substituted imidazol-2-yl, optionally substituted imidazol-4-yl, optionally substituted pyrazol-1-yl, and optionally substituted quinolin-2-yl. More preferred are those ligands as defined above with with $Z_1$, $Z_1$ and $Z_3$ containing optionally substituted pyridin-2-yl groups. Most preferred are the following ligandsL tris(pyridin-2-ylmethyl)amine, tris(3-methyl-pyridin-2-ylmethyl)amine, tris(5-methyl-pyridin-2-ylmethyl)amine, and tris(6-methyl-pyridin-2-ylmethyl) amine.

In this third variant, in the complex, $$[M_aL_kX_n]Y_m$$

preferably:

M represents a metal selected from Mn(II)-(III)-(IV)-(V), Cu(I)-(II)-(III), Fe(II)-(III)-(IV)-(V), Co(I)-(II)-(III), Ti(II)-(III)-(IV), V(II)-(III)-(IV)-(V), Mo(II)-(III)-(IV)-(V)-(VI) and W(IV)-(V)-(VI);

X represents a coordinating species selected from any mono, bi or tri charged anions and any neutral molecules able to coordinate the metal in a mono, bi or tridentate manner;

Y represents any non-coordinated counter ion;

a represents an integer from 1 to 10;

k represents an integer from 1 to 10;

n represents an integer from 1 to 10;

m represents zero or an integer from 1 to 20; and

Preferably, the bleaching composition according the invention comprises from 0.1 to 500 microM, more preferably from 0.2 to 100 microM, most preferably from 0.5 to 50 microM of organic substance (weight/volume carbon dioxide).

Especially preferred catalysts are selected from the group consisting of Dimanganese-tris-$\mu$-oxo-bis(1,4,7-trimethyl-1,4,7-triazacyclononane) bis(hexafluorophosphate), Dimanganese-bis-$\mu$-oxo-$\mu$-acetato-1,2-bis(4,7-dimethyl-1,4,7-triaza-1-cyclononyl) ethane bis(hexafluorophosphate), iron-N,N'-bis(pyridin-2-ylmethylene)-1,1,-bis(pyridin-2-yl) amino ethane bis chloride, cobalt-pentamine-$\mu$-acetate dichloride, iron-(N-Methyl-N,N',N'-tris(3-methyl-pyridin-2ylmethyl)-ethylenediamine)chloride-hexafluorphosphate and mixtures thereof.

Suitable catalysts are also described in EP-A-408 131, EP-A-384503, EP-A-458 398, U.S. Pat. No. 5,194,416, WO 96/06157 and WO 98/39405 wherein the organic part has a macrocyclic structure. Useful catalysts with a linear structure are disclosed in EP-A-392592, WO97/48710, U.S. Pat. No. 5,580,485 and EP-909 809. U.S. Pat. No. 5,705,464 describes yet another type of suitable catalysts.

Modifiers

The bleaching composition may also be designed to include a modifier, such as water, or an organic solvent up to only about 10 wt %, and usual additives to boost the bleaching and or cleaning performance such as enzymes up to about 10 wt %, surfactants, perfumes, whiteners and antistats.

In a preferred embodiment, a modifier such as water, or a useful organic solvent may be added with the stained cloth in the cleaning drum in a small volume. Preferred amounts of modifier should be from 0.0 to about 10 wt % (weight/weight of the liquid $CO_2$), more preferably 0.001 to about 5 wt %, even more preferably 0.01 to about 3 wt %, most preferably from about 0.05 to about 0.2 wt %. Preferred solvents include water, ethanol, acetone, hexane, methanol, glycols, acetonitrile, $C_{1-10}$ alcohols and $C_{5-15}$ hydrocarbons. Especially preferred solvents include water, ethanol and methanol. If the modifier is water, optionally 0.1 to 50% of an additional organic cosolvent may be present as described in U.S. Pat. No. 5,858,022. In those circumstances it may be preferred to use surfactants as described in U.S. Pat. No. 5,858,022 which do contain a CO2 philic group.

Sources of Active Oxygen

The bleaching composition comprises a source of active oxygen corresponding to 0.05 to 100 mM, preferably from 0.1 mM to 50 mM, more preferably from 0.25 to 25 mM, most preferably from 1 to 15 mM of active oxygen.

A preferred source of active oxygen is selected from the group consisting of peroxide, peracid, molecular oxygen and mixtures thereof.

One preferred source of active oxygen is molecular oxygen. The molecular oxygen may be introduced into the composition as substantially pure oxygen, mixed with other gasses, or air (atmospheric oxygen). Although the applicants do not wish to be bound by theory it is assumed that molecular oxygen is converted to an active oxygen form during interaction with the bleach catalyst and the stain. The advantage of molecular oxygen is that it negates the requirement of a peroxyl source.

If molecular oxygen is the only source of active oxygen, then the bleaching composition is preferably substantially devoid of peroxygen bleach or a peroxy-based or -generating bleach system. However, it will be appreciated that small amounts of hydrogen peroxide or peroxy-based or -generating systems may be included in the liquid composition, if desired, provided that the chemical and physical stability of the composition is not thereby adversely affected to an unacceptable level. Therefore, by "substantially devoid of peroxygen bleach or peroxy-based or -generating bleach systems" is meant that the bleaching composition comprises from 0 to 50%, preferably from 0 to 10%, more preferably from 0 to 5%, and optimally from 0 to 2% by molar weight on an oxygen basis, of peroxygen bleach or peroxy-based or -generating bleach systems. Preferably, however, the liquid bleaching composition will be wholly devoid of peroxygen bleach or peroxy-based or -generating bleach systems.

Peracids are another preferred source of active oxygen. The peracid is preferably an organic peroxyacid. Preferably, the organic peracid is selected from the group of organic and aliphatic peroxyacids and mixtures thereof. The organic peroxyacids usable in the present invention can contain either one or two peroxy groups and can be either aliphatic or aromatic. When the organic peroxyacid is aliphatic, the unsubstituted acid has the general formula:

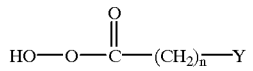

where

Y can be, for example, H, $CH_3$, $CH_2Cl$, COOH, or COOOH; and n is an integer from 1 to 20.

When the organic peroxy acid is aromatic, the unsubstituted acid has the general formula:

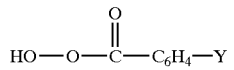

wherein

Y is hydrogen, alkyl, alkylhalogen, halogen, or COOH or COOOH.

Typical monoperoxyacids useful herein include alkyl peroxyacids and aryl peroxyacids such as:

(i) peroxybenzoic acid and ring-substituted peroxybenzoic acid, e.g. peroxy-α-naphthoic acid;

(ii) aliphatic, substituted aliphatic and arylalkyl monoperoxy acids, e.g. peroxylauric acid, peroxystearic acid, and N,N-phthaloylaminoperoxycaproic acid (PAP); and (iii) amidoperoxy acids, e.g. monononylamide of either peroxysuccinic acid (NAPSA) or of peroxyadipic acid (NAPAA).

Typical diperoxy acids useful herein include alkyl diperoxy acids and aryldiperoxy acids, such as:

(iii) 1,12-diperoxydodecanedioic acid;

(iv) 1,9-diperoxyazelaic acid;

(v) diperoxybrassylic acid; diperoxysebacic acid and diperoxyisophthalic acid;

(vi) 2-decyldiperoxybutane-1,4-dioic acid;

(vii) 4,4'-sulfonylbisperoxybenzoic acid; and (viii) N,N'-terephthaloyl-di(6-aminoperoxycaproic acid) (TPCAP).

Particularly preferred peroxy acids include PAP, TPCAP, haloperbenzoic acid and peracetic acid.

Another preferred source of active oxygen is peroxide. Peroxides are well known in the art. They include the alkali metal peroxides; organic peroxide compounds such as urea peroxide; and inorganic persalt compounds such as the alkali metal perborates, percarbonates, perphosphates, persilicates and persulphates. Mixtures of two or more such compounds may also be suitable. Particularly preferred are sodium perborate tetrahydrate and, especially, sodium perborate monohydrate. Sodium perborate monohydrate is preferred because it has excellent storage stability

Surfactants

Preferably, the bleach composition according the invention comprises a surfactant. Any surfactant suitable for use in such a composition known to the person skilled in the art may be used. Surfactants are described in U.S. Pat. No. 5,789,505, U.S. Pat. No. 5,683,977, U.S. Pat. No. 5,683,473, U.S. Pat. No. 5,858,022 and WO 96/27704. Especially preferred are the surfactants described in WO 96/27704 (formula's I–IV).

The term "densified carbon dioxide-philic" in reference to surfactants $R_nZ_m$ wherein n and m are each independently 1 to 50, means that the functional group, $R_n$— is soluble in carbon dioxide at pressures of from 101 kPa to 68.9 MPa and temperatures of from −78.5 to 100° C. to greater than 10 weight percent. Preferably n and m are each independently 1–35. Such functional groups ($R_n$—) include halocarbons, polysiloxanes and branched polyalkylene oxides.

The term "densified carbon dioxide-phobic" in reference to surfactants, $R_nZ_m$, means that $Z_m$— will have a solubility in carbon dioxide of less than 10 weight percent at pressures of from 101 kPa to 68.9 MPa and temperatures of from −78.5 to 100° C. The functional groups in $Z_m$— include carboxylic acids, phosphatyl esters, hydroxyls, $C_{1-30}$ alkyls or alkenyls, polyalkylene oxides, branched polyalkylene oxides, carboxylates, $C_{1-30}$ alkyl sulfonates, phosphates, glycerates, carbohydrates, nitrates, substituted or unsubstituted aryls and sulfates.

The hydrocarbon and halocarbon containing surfactants (i.e., $R_nZ_m$, containing the $CO_2$-philic functional group, $R_n$—, and the $CO_2$-phobic group, $Z_m$—) may have an HLB of less than 15, preferably less than 13 and most preferably less than 12.

The polymeric siloxane containing surfactants, $R_nZ_m$, also designated $MD_xD^*_yM$, with M representing trimethylsiloxyl end groups, $D_x$ as a dimethylsiloxyl backbone ($CO_2$-philic functional group) and $D^*_y$ as one or more substituted methylsiloxyl groups substituted with $CO_2$-phobic R or R' groups preferably have a $D_xD^*_y$ ratio of greater than 0.5:1, preferably greater than 0.7:1 and most preferably greater than 1:1.

A "substituted methylsiloxyl group" is a methylsiloxyl group substituted with a $CO_2$-phobic group R or R'. R or R' are each represented in the following formula:

$$—(CH_2)_a(C_6H_4)_b(A)_d—[(L)_e(A')_f]_n—(L')_gZ(G)_h$$

wherein a is 1–30, b is 0–1, $C6H_4$ is substituted or unsubstituted with a $C_{1-10}$ alkyl or alkenyl and A, d, L, e, A', F, n L', g, Z, G and h are defined below, and mixtures of R and R'.

A "substituted aryl" is an aryl substituted with a $C_{1-30}$ alkyl, alkenyl or hydroxyl, preferably a $C_{1-20}$ alkyl or alkenyl.

A "substituted carbohydrate" is a carbohydrate substituted with a $C_{1-10}$ alkyl or alkenyl, preferably a $C_{1-5}$ alkyl. The terms "polyalkylene oxide", "alkyl" and "alkenyl" each contain a carbon chain which may be either straight or branched unless otherwise stated.

A preferred surfactant which is effective for use in a liquid carbon dioxide bleach composition requires the combination of densified carbon dioxide-philic functional groups with densified carbon dioxide-phobic functional groups (see definitions above). The resulting compound may form reversed micelles with the $CO_2$-philic functional groups extending into a continuous phase and the $CO_2$-phobic functional groups directed toward the centre of the micelle.

The surfactant is present in an amount of from 0.001 to 10 wt %, preferably 0.01 to 5 wt %. An especially preferred range is from about 0.03% to about 1 wt %.

The $CO_2$-philic moieties of the surfactants are groups exhibiting low Hildebrand solubility parameters, as described in Grant, D. J. W. et al. "Solubility Behavior of Organic Compounds", Techniques of Chemistry Series, J. Wiley & Sons, NY (1990) pp. 46–55 which describes the Hildebrand solubility equation, herein incorporated by reference. These $CO_2$-philic moieties also exhibit low polarisability and some electron donating capability allowing them to be solubilized easily in densified fluid carbon dioxide.

As defined above the $CO_2$-philic functional groups are soluble in densified carbon dioxide to greater than 10 weight percent, preferably greater than 15 weight percent, at pressures of from 101 kPa to 68.9 MPa and temperatures of from −78.5 to 100° C.

Preferred densified $CO_2$-philic functional groups include halocarbons (such as fluoro-, chloro- and fluorochlorocarbons), polysiloxanes and branched polyalkylene oxides.

The $CO_2$-phobic portion of the surfactant molecule is obtained either by a hydrophilic or a hydrophobic functional group which is less than 10 weight percent soluble in densified $CO_2$, preferably less than 5 wt. %, at a pressures of from 101 kPa to 68.9 MPa and temperatures of from −78.5 to 100° C. Examples of moieties contained in the $CO_2$-phobic groups include polyalkylene oxides, carboxylates, branched acrylate esters, $C_{1-30}$ hydrocarbons, aryls which are unsubstituted or substituted, sulfonates, glycerates, phosphates, sulfates and carbohydrates. Especially preferred $CO_2$-phobic groups include $C_{2-20}$ straight chain or branched alkyls, polyalkylene oxides, glycerates, carboxylates, phosphates, sulfates and carbohydrates.

Preferred surfactants comprise $CO_2$-philic and $CO_2$-phobic groups. The $CO_2$-philic and $CO_2$-phobic groups are preferably directly connected or linked together via a linkage group. Such groups preferably include ester, keto, ether, amide, amine, thio, alkyl, alkenyl, fluoroalkyl, fluoroalkenyl and mixtures thereof.

A preferred surfactant is:

$$R_nZ_m$$

wherein $R_n$— is a densified $CO_2$-philic functional group, R is a halocarbon, a polysiloxane, or a branched polyalkylene oxide and n is 1–50, and $Z_m$— is a densified $CO_2$-phobic functional group, and m is 1–50 and at pressures of 101 kPa to 68.9 MPa and temperatures of from −78.5 to 100° C., the $R_n$— group is soluble in the densified carbon dioxide to greater than 10 wt. percent and the $Z_m$— group is soluble in the densified carbon dioxide to less than 10 wt. percent.

It should be understood that $R_n$— and $Z_m$— may be present in any sequence, e.g. RZR, ZRZ, RRRZ, RRRZRZ etc. etc. Preferably, when R of the surfactant is the halocarbon or the branched polyalkylene oxide, then the surfactant has an HLB value of less than 15. In other cases it may be preferred that when R is the polysiloxane, then the surfactant has a ratio of dimethyl siloxyl to substituted methyl siloxy groups of greater than 0.5:1.

Surfactants which are useful in the invention may be selected from four groups of compounds (forumula I–IV). The first group of compounds has the following formula:

$$[(CX_3(CX_2)_a(CH_2)_b)_c(A)_d\text{—}[(L)_e\text{—}(A')_f]_n\text{—}(L')_g]_oZ(G)_h \qquad \text{(I)}$$

wherein

X is F, Cl, Br, I and mixtures thereof, preferably F and Cl;

a is 1–30, preferably 1–25, most preferably 5–20;

b is 0–5, preferably 0–3;

c is 1–5, preferably 1–3;

A and A' are each independently a linking moiety representing an ester, a keto, an ether, a thio, an amido, an amino, a $C_{1-4}$ fluoroalkyl, a $C_{1-4}$ fluoroalkenyl, a branched or straight chain polyalkylene oxide, a phosphato, a sulfonyl, a sulfate, an ammonium and mixtures thereof;

d is 0 or 1;

L and L' are each independently a $C_{1-30}$ straight chained or branched alkyl or alkenyl or an aryl which is unsubstituted or substituted and mixtures thereof;

e is 0–3;

f is 0 or 1;

n is 0–10, preferably 0–5, most preferably 0–3;

g is 0–3;

o is 0–5, preferably 0–3;

Z is a hydrogen, a carboxylic acid, a hydroxy, a phosphate, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, (preferably $C_{1-25}$ alkyl), a carbohydrate unsubstituted or substituted with a $C_{1-10}$ alkyl or alkenyl (preferably a $C_{1-5}$ alkyl) or an ammonium; G is an anion or cation such as $H^+$, $Na^+$, $Li^+$, $K^+$, $NH_4^+$ $Ca^{+2}$, $Mg^{+2}$; $Cl^-$, $Br^-$, $I^-$, mesylate, or tosylate; and h is 0–3, preferably 0–2.

Preferred compounds within the scope of the formula I include those having linking moieties A and A' which are each independently an ester, an ether, a thio, a polyalkylene oxide, an amido, an ammonium and mixtures thereof;

L and L' are each independently a $C_{1-25}$ straight chain or branched alkyl or unsubstituted aryl; and Z is a hydrogen, carboxylic acid, hydroxyl, a phosphato, a sulfonyl, a sulfate, an ammonium, a polyalkylene oxide, or a carbohydrate, preferably unsubstituted. G groups which are preferred include $H^+$, $Li^+$, $Na^+$, $NH^+_4$, $Cl^-$, $Br^-$ and tosylate.

Most preferred compounds within the scope of formula I include those compounds wherein A and A' are each independently an ester, ether, an amido, a polyoxyalkylene oxide and mixtures thereof; L and L' are each independently a $C_{1-20}$ straight chain or branched alkyl or an unsubstituted aryl; Z is a hydrogen, a phosphate, a sulfonyl, a carboxylic acid, a sulfate, a poly(alkylene oxide) and mixtures thereof; and G is $H^+$, $Na^+$ or $NH_4^+$.

Compounds of formula I are prepared by any conventional preparation method known in the art such as the one described in March, J., "Advanced Organic Chemistry", J. Wiley & Sons, NY (1985).

Commercially available fluorinated compounds include compounds supplied as the Zonyl™ series by Dupont.

The second group of surfactants useful in the bleach composition are those compounds having a polyalkylene moiety and having a formula (II).

$$[H\text{—}[CH(R)\text{—}CH(R')\text{—}O]_i\text{—}(A)_d\text{—}[(L)_e\text{—}(A')_f]_n\text{—}(L')_g]_oZ(G)_h \qquad \text{(II)}$$

wherein

R and R' each represent a hydrogen, a $C_{1-5}$ straight chained or branched alkyl or alkylene oxide and mixtures thereof;

i is 1 to 50, preferably 1 to 30, and

A, A', d, L, L', e f, n, g, o, Z, G and h are as defined above.

Preferably R and R' are each independently a hydrogen, a $C_{1-3}$ alkyl, or alkylene oxide and mixtures thereof.

Most preferably R and R' are each independently a hydrogen, $C_{1-3}$ alkyl and mixtures thereof. Non-limiting examples of compounds within the scope of formula II are described in WO 96/27704 Compounds of formula II may be prepared as is known in the art and as described in March et al., Supra.

Examples of commercially available compounds of formula II may be obtained as the Pluronic™ series from BASF, Inc.

A third group of surfactants useful in the invention contain a fluorinated oxide moiety and the compounds have a formula:

$$[(CX_3(XO)_r(T)_s)_c(A)_d\text{—}[(L)_e\text{—}(A')_f\text{—}]_n(L')_g]_oZ(G)_h \qquad \text{(III)}$$

wherein

XO is a halogenated alkylene oxide having $C_{1-6}$ straight or branched halocarbons, preferably $C_{1-3}$, r is 1–50, preferably 1–25, most preferably 5–20, T is a straight chained or branched haloalkyl or haloaryl, s is 0 to 5, preferably 0–3, X, A, A', c, d, L, L', e, f, n, g, o, Z, G and h are as defined above.

Examples of commercially available compounds within the scope of formula III include those compounds supplied under the Krytox™ series by DuPont having a formula:

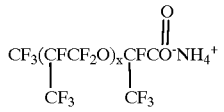

wherein x is 1–50.

Other compounds within the scope of formula III are made as known in the art and described in March et al., Supra.

The fourth group of surfactants useful in the invention include siloxanes containing surfactants of formula IV $$MD_xD^*_yM \qquad (IV)$$

wherein

M is a trimethylsiloxyl end group, $D_x$ is a dimethylsiloxyl backbone which is $CO_2$-philic and $D^*_y$ is one or more methylsiloxyl groups which are substituted with a $CO_2$-phobic R or R' group, wherein R and R' each independently have the following formula:

$$(CH_2)_a(C_6H_4)_b(A)_d—[(L)_e—(A')_f—]_n—(L')_gZ(G)_h$$

wherein a is 1–30, preferably 1–25, most preferably 1–20, b is 0 or 1, $C_6H_4$ is unsubstituted or substituted with a $C_{1-10}$ alkyl or alkenyl, and A, A', d, L, e, f, n, L', g, Z, G and h are as defined above and mixtures of R and R' thereof.

The $D_x$:$D^*_y$ ratio of the siloxane containing surfactants should be greater than 0.5:1, preferably greater than 0.7:1 and most preferably greater than 1:1.

The siloxane compounds should have a molecular weight ranging from 100 to 100,000, preferably 200 to 50,000, most preferably 500 to 35,000.

Silicones may be prepared by any conventional method such as the method described in Hardman, B. "Silicones" the *Encyclopedia of Polymer Science and Engineering,* v. 15, 2nd Ed., J. Wiley and Sons, NY, N.Y. (1989).

Examples of commercially available siloxane containing compounds which may be used in the invention are those supplied under the ABIL series by Goldschmidt.

Suitable siloxane compounds within the scope of formula IV are compounds of formula V:

(V)

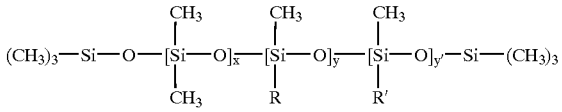

the ratio of x:y and y' is greater than 0.5:1, preferably greater than 0.7:1 and most preferably greater than 1:1, and R and R' are as defined above.

Preferred $CO_2$-phobic groups represented by R and R' include those moieties of the following formula:

$$(CH_2)_a(C_6H_4)_b(A)_d—[(L)_e—(A')_f—]—(L')_gZ(G)_h$$

wherein a is 1–20, b is 0, $C_6H_4$ is unsubstituted,

A, A', d, L, e, f, n, g, Z, G and h are as defined above, and mixtures of R and R'.

Particularly useful surfactants are selected from the group consisting of the classes of ethoxy modified polydimethylsiloxanes (e.g. Silwet™™ surfactants from Witco), acetylenic glycol surfactants (from Air Products) and ethoxy/propoxy block copolymers (e.g. Pluronic™™ surfactants from BASF) and mixtures thereof.

Method of Bleaching

The method of bleaching with liquid carbon dioxide comprises the step of a) loading a variety of soiled articles, preferably clothing, into a vessel (preferably a pressurisable vessel) and b) contacting the articles with the bleaching composition according the invention. The bleaching composition minus the liquid carbon dioxide may be contacted with the soiled articles before or together with the carbon dioxide.

If the main source of active oxygen is molecular oxygen like atmosperic oxygen, the bleaching method preferably comprises step c) of exposing the article to air, preferably at an elevated temperature.

Therefore, one preferred embodiment of the present invention encompasses a bleaching method comprising the steps of contacting an article with a bleaching composition according to the invention that comprises an organic substance which forms a complex with a transition metal, the complex catalysing bleaching by atmospheric oxygen, whereby the complex catalyses bleaching of the textile by atmospheric oxygen after the treatment. The bleaching composition is preferably substantially devoid of peroxygen bleach or a peroxy-based or -generating bleach system, The liquid carbon dioxide may be introduced into the cleaning vessel as described in U.S. Pat. No. 5,683,473. Preferably, the liquid carbon dioxide is introduced into the cleaning vessel which is then pressurised to a pressure in the range of about 0.1 to about 68.9 MPa and adjusted to a temperature range of from about −78.5° C. up to about 30° C. so that the carbon dioxide is in a liquid phase. Preferably the pressure range is from 0.5 to 48 MPa, more preferably from 2.1 to 41 MPa. Preferably, the temperature range is from −56.2 to 25° C., more preferably from −25° C. to 20° C.

After the bleaching step, the articles may be rinsed by introducing fresh carbon dioxide into the vessel after removing the bleaching composition.

Method of Preparing the Bleaching Composition

Preferably, the organic substance is dissolved or dispersed in a compatible solvent prior to mixing the organic substance with the carbon dioxide. The compatibility of the solvent will depend on the exact nature of the organic substance. If the organic substance is more or less hydrophobic then a hydrophobic fluid may be preferred. Alternatively if the organic substance is more or less hydrophilic, a hydrophilic fluid may be preferred. In many cases it will be preferable, to add the organic substance dissolved or dispersed in an aqueous solvent. If a solvent other than carbon dioxide is needed to dissolve the organic substance, the bleaching composition preferably further comprises 0.001 to 10 wt % (w/w) of the compatible solvent. The bleach compatible solvent is preferably a modifier as herein defined.

Other than in the examples, or where otherwise indicated, all numbers expressing quantities of ingredients or reaction conditions used herein are to be understood as modified in all instances by the term "about". Similarly, all percentages are weight/weight percentages of the liquid carbon dioxide unless otherwise indicated. Molar ranges are weight per volume of carbon dioxide. Where the term comprising is used in the specification or claims, it is not intended to exclude any terms, steps or features not specifically recited.

The following examples will more fully illustrate the embodiments of the invention. The definition and examples are intended to illustrate and not limit the scope of the invention.

EXAMPLES

Example 1

The commercially available, bleach sensitive test cloth BC-1 was dry cleaned using liquid carbon dioxide, hydrogen peroxide, bleach catalysts and mixtures thereof according to the invention.

BC-1 is a tea stained test cloth made by CFT. Four 2"×2" cloths were placed in a 600 ml autoclave having a gas compressor, an extraction composition and a stirrer. The cloths were allowed to move freely in the autoclave. Good agitation was ensured by visual observation with an endoscope through a small sapphire window in the autoclave. After placing the cloths in the autoclave and sealing it, liquid $CO_2$ at a tank pressure of 5.86 Mpa was allowed into the composition and was cooled to reach a temperature of about 12° C. at which point the liquid $CO_2$ was at a pressure of about 5.52 MPa. The stirrer was then turned on for 15 minutes to mimic a wash cycle. Optionally, at the completion of the wash cycle fresh $CO_2$ may be passed through the composition to mimic a rinse cycle. The pressure of the autoclave was then released to atmospheric pressure and the cleaned cloths were removed from the autoclave. Two runs were performed with each composition tested. To measure the extent of cleaning, the cloths were placed in a Reflectometer supplied by Colorguard. The R scale, which measures darkness from black to white, was used to determine stain removal. Cleaning results were reported as the percent stain removal according to the following calculation:

$$\%\ \text{stain removal} = \frac{\text{stain removed}}{\text{stain applied}} = \frac{\text{cleaned cloth reading} - \text{stained cloth reading}}{\text{unstained cloth reading} - \text{stained cloth reading}} \times 100\,\%$$

The following bleach catalysts were used at the indicated concentrations in liquid $CO_2$:

Catalyst 1 (as described in EP-A-458 397 (Unilever)): Dimanganese-tris-$\mu$-oxo-bis(1,4,7-trimethyl-1,4,7-triazacyclononane)bis(hexafluorophosphate) dosed at 2.5 $\mu$M Catalyst 2 (as described in WO-A-96/06154 (Unilever)): Dimanganese-bis-$\mu$-oxo-$\mu$-acetato-1,2-bis(4,7-dimethyl-1,4,7-triaza-1-cyclononyl) ethane bis (hexafluorophosphate) dosed at 2.5 $\mu$M Catalyst 3 (synthesis described in EP-A-909 809 (Unilever)): Iron-N,N'-bis(pyridin-2-ylmethylene)-1,1,-bis(pyridin-2-yl) amino ethane bis chloride dosed at 10 $\mu$M Catalyst 4 (as described in EP-A-272 030 (Interox)): Cobalt-pentamine-$\mu$-acetate dichloride dosed at 10 $\mu$M The bleach catalysts were predissolved in water such that dosing 1 mL of stock solution into the autoclave yielded the desired concentration. In each experiment, 10 mM of hydrogen peroxide was used and delivered from 30% active solution.

Bleaching results on BC-1 are in Table 1 below.

TABLE 1

Bleach Results on BC-1 using Bleach catalysts at 12° C. and 5.52 MPa

| Bleach Composition | % Soil Removal |
|---|---|
| $CO_2$ alone | −2 |
| Hydrogen peroxide | 26 |
| Hydrogen peroxide + catalyst 1 | 84 |
| Hydrogen peroxide + catalyst 2 | 61 |
| Hydrogen peroxide + catalyst 3 | 70 |
| Hydrogen peroxide + catalyst 4 | 65 |

The results show that when a bleach catalyst is used in combination with hydrogen peroxide, excellent bleaching results on this bleach sensitive cloth are obtained.

Example 2

The bleach sensitive, grass stained test cloth CS-8 made by CFT was cleaned as described in Example 1. Excellent bleaching was obtained as % soil removal using hydrogen peroxide plus Catalyst 4 was 37 compared with $CO_2$ alone at 0, and with hydrogen peroxide and no catalyst % soil removal was 13.

Example 3

BC-1 stain test cloths were cleaned as described in Example 1 with the exceptions that the liquid $CO_2$ was cooled down to −10 ° C. and the pressure adjusted to 2.41 MPa, and, 0.44 g of propylene glycol was added to the composition to prevent the water from freezing. Bleaching results on BC-1 for this temperature and pressure are shown in Table 2.

TABLE 2

Bleach Results on BC-1 using Bleach catalysts at −10° C. and 2.41 MPa

| Bleach Composition | % Soil Removal |
|---|---|
| $CO_2$ alone | 0 |
| Hydrogen peroxide | 38 |
| Hydrogen peroxide + catalyst 1 | 47 |
| Hydrogen peroxide + catalyst 2 | 55 |
| Hydrogen peroxide + catalyst 3 | 56 |
| Hydrogen peroxide + catalyst 4 | 56 |

The results show that when a bleach catalyst is used in combination with hydrogen peroxide, very good bleaching results on this bleach sensitive cloth are obtained even at this low temperature.

Example 4

CS-8 stained cloths were cleaned as described in Example 1 with the exceptions that the liquid $CO_2$ was cooled down to −10° C. and the pressure adjusted to 2.41 MPa, and, 0.44 g of propylene glycol was added to the composition to prevent the water from freezing. Very good bleaching was obtained as % soil removal using hydrogen peroxide plus Catalyst 4 was 38 compared with $CO_2$ alone at 0, and with hydrogen peroxide and no catalyst % soil removal was 18.

Example 5

In Table 3 is shown a bleaching composition which is useful within the scope of this invention.

TABLE 3

| Ingredient | Concentration |
|---|---|
| Hydrogen peroxide | 10 mM |
| Catalyst 1 | 2.5 μM |
| Silwet ™ L-7602* | 0.05 wt % |
| Water | 0.1 wt % |

*Silwet ™ L-7602 is an organosilicone surfactant from Witco.

Example 6

In Table 4 is shown a bleaching composition which is useful within the scope of this invention.

TABLE 4

| Ingredient | Concentration |
|---|---|
| Hydrogen peroxide | 10 mM |
| Catalyst 3 | 10 μM |
| Silwet ™ L-7602* | 0.05 wt % |
| Water | 0.1 wt % |

*Silwet ™ L-7602 is an organosilicone surfactant from Witco.

Example 7

In Table 5 is shown a bleaching composition which is useful within the scope of this invention.

TABLE 5

| Ingredient | Concentration |
|---|---|
| Hydrogen peroxide | 10 mM |
| Catalyst 1 | 2.5 μM |
| Silwet ™ L-7602* | 0.2 wt % |
| Water | 0.1 wt % |

*Silwet ™ L-7602 is an organosilicone surfactant from Witco.

Example 8

In Table 6 is shown a bleaching composition which is useful within the scope of this invention.

TABLE 6

| Ingredient | Concentration |
|---|---|
| Hydrogen peroxide | 10 mM |
| Catalyst 3 | 10 μM |
| Silwet ™ L-7602* | 0.2 wt % |
| Water | 0.1 wt % |

*Silwet ™ L-7602 is an organosilicone surfactant from Witco.

Example 9

In Table 7 is shown a bleaching composition which is useful within the scope of this invention.

TABLE 7

| Ingredient | Concentration |
|---|---|
| Hydrogen peroxide | 10 mM |
| Catalyst 1 | 2.5 μM |
| Pluronic ™ L-62* | 0.05 wt % |
| Water | 0.1 wt % |

*Pluronic ™ L-62 is an ethoxy/propoxy block copolymer from BASF.

Example 10

In Table 8 is shown a bleaching composition which is useful within the scope of this invention.

TABLE 8

| Ingredient | Concentration |
|---|---|
| Hydrogen peroxide | 10 mM |
| Catalyst 3 | 10 μM |
| Pluronic ™ L-62* | 0.05 wt % |
| Water | 0.1 wt % |

*Pluronic ™ L-62 is an ethoxy/propoxy block copolymer from BASF.

Example 11

In Table 9 is shown a bleaching composition which is useful within the scope of this invention.

TABLE 9

| Ingredient | Concentration |
|---|---|
| Hydrogen peroxide | 10 mM |
| Catalyst 3 | 10 μM |
| Surfynol ™ 440* | 0.05 wt % |
| Water | 0.1 wt % |

*Surfynol ™ 440 is an ethoxy-modified tertiary acetylenic glycol surfactant from Air Products.

Example 12

Bleaching was also carried out in the absence of hydrogen peroxyde. Instead, atmospheric oxygen was used as the source of active oxygen to bleach 12 test cloths with tomato elefante stains. For this experiment catalyst 3 and catalyst 5 (as described in WO-A-00/27976 (Unilever)): (N-methyl-N,N',N'-tris(3-methylpyridin-2ylmethyl)ethylenediamine) were used. Catalyst 3 was prepared as follows: MeN4Py ligand (33.7 g; 88.5 mmoles) was dissolved in 500 ml dry methanol. Small portions of $FeCl_2.4H_2O$ (0.95 eq; 16.7 g; 84.0 mmoles) were added, yielding a clear red solution. After addition, the solution was stirred for 30 minutes at room temperature, after which the methanol was removed (rotary-evaporator). The dry solid was ground and 150 ml of ethylacetate was added and the mixture was stirred until a fine red powder was obtained. This powder was washed twice with ethyl acetate, dried in the air and further dried under vacuum (40° C.). El. Anal. Calc. for [Fe(MeN4py)Cl]Cl.$2H_2O$: C 53.03; H 5.16; N 12.89; Cl 13.07; Fe 10.01%. Found C 52.29/52.03; H 5.05/5.03; N 12.55/12.61; Cl: 12.73/12.69; Fe: 10.06/10.01%.

The experimental setup as described in example 1 was used whereby catalyst 3 and catalyst 5 respectively were predissolved in a 1:1 mixture of demineralised water and ethanol to yield a concentration of 10 microM (w/v) in CO2. The end concentration of water in the bleaching composition was 0.5 wt %. The remaining parameters such as the amount of carbon dioxide, temperature, duration used were as described in example 1. Excellent bleaching was obtained using either catalyst. With Catalyst 3, bleaching continued after the cloth was removed from the CO2 and when the cloth was exposed to hot air to dry.

Similar results were obtained when the experiment was repeated with catalyst 3 predissolved in water only. The atmosperic oxygen in the autoclave was derived from the air trapped in the autoclave (600 ml) before carbon dioxide was introduced in the system and corresponds to an endconcentration of 9 mM oxygen (w/v).

What is claimed is:

1. A bleaching composition comprising:

a) from 0.05 microM to 50 mM of a complex comprising an organic substance which forms the complex with a transition metal, the complex having the general formula (A1):

$$[M_aL_kX_n]Y_m \quad (A1)$$

in which:

M represents a metal selected from Mn(II)-(III)-(IV)-(V), Cu(I)-(II)-(III), Fe(I)-(II)-(III)-(IV), Co(I)-(II)-(III), Ni(I)-(II)-(III), Cr(II)-(III)-(IV)-(V)-(VI)-(VII), Ti(II)-(III)-(IV), V(II)-(III)-(IV)-(V), Mo(II)-(III)-(IV)-(V)-(VI), W(IV)-(V)-(VI), Pd(II), Ru(II)-(III)-(IV)-(V) and Ag(I)-(II);

L represents a ligand, or its protonated or deprotonated analogue;

X represents a coordinating species selected from any mono, bi or tri charged anions and any neutral molecules able to coordinate the metal in a mono, bi or tridentate manner;

Y represents any non-coordinated, counter ion;

a represents an integer from 1 to 10;

k represents an integer from 1 to 10;

n represents zero or an integer from 1 to 10; and m represents zero or an integer from 1 to 20;

b) a source of active oxygen corresponding to 0.05 to 100 mM (w/v) of active oxygen; and c) a dry cleaning effective amount of liquid carbon dioxide.

2. A composition according to claim 1 characterised in that the composition comprises less than 10 wt % of a modifier.

3. A composition according to claim 1 characterised in that composition comprises a source of active oxygen corresponding to from 0.1 mM to 50 mM of active oxygen.

4. A composition according to claim 1 characterised in that the composition comprises from 0.1 to 500 microM of the complex.

5. A composition according to claim 1 characterised in that the composition comprises from 0.001 to 10 wt % of a surfactant.

6. A composition according to claim 5 characterised in that the surfactant is represented by a formula $$R_nZ_m$$

wherein $R_n$ is a densified $CO_2$-philic functional group, R is a halocarbon, a polysiloxane, or a branched polyalkylene oxide and n is 1–50;

$Z_m$— is a densified $CO_2$-phobic functional group and m is 1–50; and at pressures of 101 kPa to 68.9 MPa and temperatures of from −78.5 to 100° C., the Rn— group is soluble in the densified carbon dioxide to greater than 10 wt. percent and the Zm— group is soluble in the densified carbon dioxide to less than 10 wt. percent.

7. A composition according to claim 5 characterised in that the surfactant is selected from surfactants whereof the $CO_2$-philic and $CO_2$-phobic groups are directly connected or linked together via a linkage group, said linkage group being selected from ester, keto, ether, amide, amine, thio, alkyl, alkenyl, fluoroalkyl, fluoroalkenyl and mixtures thereof.

8. A composition according to claim 5 characterised in that the surfactant is selected from the group consisting of ethoxy modified polydimethylsiloxanes, acetylenic glycol surfactants, ethoxy/propoxy block copolymers and mixtures thereof.

9. A composition according to claim 1 characterised in that the active oxygen is derived from a source selected from the group consisting of peroxide, peracid, molecular oxygen and mixtures thereof.

10. A composition according to claim 9 characterised in that the peracid is selected from the group of organic and aliphatic peroxyacids and mixtures thereof.

11. A bleaching composition according to claim 1, wherein in formula (A1):

X represents a coordinating species selected from $O^{2-}$, $RBO_2^{2-}$, $RCOO^-$, $RCONR^-$, $OH^-$, $NO_3^-$, $NO_2^-$, NO, CO, $S^{2-}$, $RS^-$, $PO_3^{4-}$, STP-derived anions, $PO_3OR^{3-}$, $H_2O$, $CO_3^{2-}$, $HCO_3^-$, ROH, NRR'R", RCN, $Cl^-$, $Br^-$, $OCN^-$, $SCN^-$, $CN^-$, $N_3^-$, $F^-$, $I^-$, $RO^-$, $ClO_4^-$, $SO_4^{2-}$, $HSO_4^-$, $SO_3^{2-}$ and $RSO_3^-$; and Y represents a counter ion selected from $ClO_4^-$, $BR_4^-$, $[FeCl_4]^-$, $PF_6^-$, $RCOO^-$, $NO_3^-$, $NO_2^-$, $RO^-$, $N^+RR'R''R'''$, $Cl^-$, $Br^-$, $F^-$, $I^-$, $RSO_3^-$, $S_2O_6^{2-}$, $OCN^-$, $SCN^-$, $Li^+$, $Ba^{2+}$, $Na^+$, $Mg^{2+}$, $K^+$, $Ca^{2+}$, $Cs^+$, $PR_4^+$, $RBO_2^{2-}$, $SO_4^{2-}$, $HSO_4^-$, $SO_3^{2-}$, $SbCl_6^-$, $CuCl_4^{2-}$, CN, $PO_4^{3-}$, $HPO_4^{2-}$, $H_2PO_4^-$, STP-derived anions, $CO_3^{2-}$, $HCO_3^-$ and $BF_4^-$, wherein R, R', R", R"' independently represent a group selected from hydrogen, hydroxyl, —OR (wherein R=alkyl, alkenyl, cycloalkyl, heterocycloalkyl, aryl, heteroaryl or carbonyl derivative group), —OAr, alkyl, alkenyl, cycloalkyl, heterocycloalkyl, aryl, heteroaryl and carbonyl derivative groups, each of R, Ar, alkyl, alkenyl, cycloalkyl, heterocycloalkyl, aryl, heteroaryl and carbonyl derivative groups being optionally substituted by one or more functional groups E, or R6 together with R7 and independently R8 together with R9 represent oxygen;

E is selected from functional groups containing oxygen, sulphur, phosphorus, nitrogen, selenium, halogens, and any electron donating and/or withdrawing groups.

12. A bleaching composition according to claim 1, wherein in formula (A1):

M represents a metal selected from Mn(II)-(III)-(IV)-(V), Cu(I)-(II), Fe(II)-(III)-(IV) and Co(I)-(II)-(III);

X represents a coordinating species selected from $O^{2-}$, $RBO_2^{2-}$, $RCOO^-$, $OH^-$, $NO_3^-$, $NO_2^-$, NO, CO, $CN^-$, $S^{2-}$, $RS^-$, $PO_3^{4-}$, $H_2O$, $CO_3^{2-}$, $HCO_3^-$, ROH, NRR'R", $Cl^-$, $Br^-$, $OCN^-$, $SCN^-$, RCN, $N_3^-$, $F^-$, $I^-$, $RO^-$, $ClO_4^-$, $SO_4^{2-}$, $HSO_4^-$, $SO_3^{2-}$ and $RSO_3^-$;

Y represents a counter ion selected from $ClO_4^-$, $BR_4^-$, $[FeCl_4]^-$, $PF_6^-$, $RCOO^-$, $NO_3^-$, $NO_2^-$, $RO^-$, $N^+RR'R''R'''$, $Cl^-$, $Br^-$, $F^-$, $I^-$, $RSO_3^-$, $S_2O_6^{2-}$, $OCN^-$, $SCN^-$, $Li^+$, $Ba^{2+}$, $Na^+$, $Mg^{2+}$, $K^+$, $Ca^{2+}$, $PR_4^+$, $SO_4^{2-}$, $HSO_4^-$, $SO_3^{2-}$ and $BF_4^-$, wherein R, R', R', R"' represent represent hydrogen, optionally substituted alkyl or optionally substituted aryl;

a represents an integer from 1 to 4;

k represents an integer from 1 to 10;

n represents zero or an integer from 1 to 4; and m represents zero or an integer from 1 to 8.

13. A bleaching composition according to claim 1, wherein L represents a ligand of the general formula (BI):

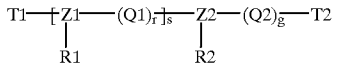

wherein g represents zero or an integer from 1 to 6;

r represents an integer from 1 to 6;

s represents zero or an integer from 1 to 6;

Z1 and Z2 independently represent a heteroatom or a heterocyclic or heteroaromatic ring, Z1 and/or Z2 being optionally substituted by one or more functional groups E as defined below;

Q1 and Q2 independently represent a group of the formula:

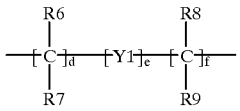

wherein

10>d+e+f>1; d=0–9; e=0–9; f=0–9;

each Y1 is independently selected from —O—, —S—, —SO—, —$SO_2$—, —$(G^1)$N—, —$(G^1)(G^2)$N— (wherein $G^1$ and $G^2$ are as defined below), —C(O)—, arylene, alkylene, heteroarylene, —P— and —P(O)—;

if s>1, each —[—Z1(R1—$(Q1)_r$—]— group is independently defined;

R1, R2, R6, R7, R8, R9 independently represent a group selected from hydrogen, hydroxyl, —OR (wherein R=alkyl, alkenyl, cycloalkyl, heterocycloalkyl, aryl, heteroaryl or carbonyl derivative group), —OAr, alkyl, alkenyl, cycloalkyl, heterocycloalkyl, aryl, heteroaryl and carbonyl derivative groups, each of R, Ar, alkyl, alkenyl, cycloalkyl, heterocycloalkyl, aryl, heteroaryl and carbonyl derivative groups being optionally substituted by one or more functional groups E, or R6 together with R7 and independently R8 together with R9 represent oxygen;

E is selected from functional groups containing oxygen, sulphur, phosphorus, nitrogen, selenium, halogens, and any electron donating and/or withdrawing groups (preferably E is selected from hydroxy, mono- or polycarboxylate derivatives, aryl, heteroaryl, sulphonate, thiol (—RSH), thioethers (—R—S—R'), disulphides (—RSSR'), dithiolenes, mono- or polyphosphonates, mono- or polyphosphates, electron donating groups and electron withdrawing groups, and groups of formulae $(G^1)(G^2)$N—, $(G^1)(G^2)$ $(G^3)$N—, $(G^1)(G^2)$N—C(O)—, $G^3$O— and $G^3$C(O)—, wherein each of $G^1$, $G^2$ and $G^3$ is independently selected from hydrogen, alkyl, electron donating groups and electron withdrawing groups (in addition to any amongst the foregoing));

or one of R1–R9 is a bridging group bound to another moiety of the same general formula;

T1 and T2 independently represent groups R4 and R5, wherein R4 and R5 are as defined for R1–R9, and if g=0 and s>0, R1 together with R4, and/or R2 together with R5, may optionally independently represent =CH—R10, wherein R10 is as defined for R1–R9, or T1 and T2 may together (—T2—T1—) represent a covalent bond linkage when s>1 and g>0;

if Z1 and/or Z2 represent N and T1 and T2 together represent a single bond linkage and R1 and/or R2 are absent, Q1 and/or Q2 may independently represent a group of the formula: =CH—[—Y1—]$_e$—CH=, optionally any two or more of R1, R2, R6, R7, R8, R9 independently are linked together by a covalent bond;

if Z1 and/or Z2 represents O, then R1 and/or R2 do not exist;

if Z1 and/or Z2 represents S, N, P, B or Si then R1 and/or R2 may be absent;

if Z1 and/or Z2 represents a heteroatom substituted by a functional group E then R1 and/or R2 and/or R4 and/or R5 may be absent.

14. A bleaching composition according to claim 13, wherein Z1 and Z2 independently represent an optionally substituted heteroatom selected from N, P, O, S, B and Si or an optionally substituted heterocyclic ring or an optionally substituted heteroaromatic ring selected from pyridine, pyrimidines, pyrazine, pyrazidine, pyrazole, pyrrole, imidazole, benzimidazole, quinoline, isoquinoline, carbazole, triazole, indole, isoindole, furane, thiophene, oxazole and thiazole.

15. A bleaching composition according to claim 13, wherein R1–R9 are independently selected from —H, hydroxy-$C_0$–$C_{20}$-alkyl, halo-$C_0$–$C_{20}$-alkyl, nitroso, formyl-$C_0$–$C_{20}$-alkyl, carboxyl-$C_0$–$C_{20}$-alkyl and esters and salts thereof, carbamoyl-$C_0$–$C_{20}$-alkyl, sulpho-$C_0$–$C_{20}$-alkyl and esters and salts thereof, sulphamoyl-$C_0$–$C_{20}$-alkyl, amino-$C_0$–$C_{20}$-alkyl, aryl-$C_0$–$C_{20}$-alkyl, heteroaryl-$C_0$–$C_{20}$-alkyl, $C_0$–$C_{20}$-alkyl, alkoxy-$C_0$–$C_8$-alkyl, carbonyl-$C_0$–$C_6$-alkoxy, and aryl-$C_0$-$C_6$-alkyl and $C_0$–$C_{20}$-alkylamide;

or one of R1–R9 is a bridging group —$C_n$(R11)(R12)—$(D)_p$—$C_m$(R11)(R12)— bound to another moiety of the same general formula, wherein p is zero or one, D is selected from a heteroatom or a heteroatom-containing group, or is part of an aromatic or saturated homonuclear and heteronuclear ring, n' is an integer from 1 to 4, m' is an integer from 1 to 4, with the proviso that n'+m'<=4, R11 and R12 are each independently preferably selected from —H, NR13 and OR14, alkyl, aryl, optionally substituted, and R13 and R14 are each independently selected from —H, alkyl, aryl, both optionally substituted.

16. A bleaching composition according to claim 13, wherein T1 and T2 independently represent groups R4, R5 as defined for R1–R9, according to the general formula (BIII):

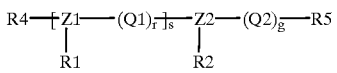

17. A bleaching composition according to claim 16, wherein in general formula (BIII), s=1; r=1; g=0; d=f=1; e=1–4; Y1=—C(R')(R"), wherein R' and R" are independently as defined for R1–R9.

18. A bleaching composition according to claim 17, wherein the ligand has the general formula:

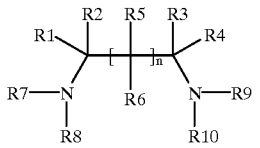

19. A bleaching composition according to claim 18, wherein R1, R2, R3, R4, R5 are —H or $C_0$–$C_{20}$-alkyl, n=0 or 1, R6 is —H, alkyl, —OH or —SH, and R7, R8, R9, R10 are each independently selected from —H, $C_0$–$C_{20}$-alkyl, heteroaryl-$C_0$–$C_{20}$-alkyl, alkoxy-$C_0$–$C_8$-alkyl and amino-$C_0$–$C_{20}$-alkyl.

20. A bleaching composition according to claim 16 wherein in the complex of the general formula (A1):

M=Mn(II)–(IV), Fe(II)–(III), Cu(II), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4;

m=0, 1, 2, 3, 4, 5, 6, 7, 8; and k=1, 2, 3, 4.

21. A bleaching composition according to claim 16, wherein in general formula (BIII), s=0; g=1; d=e=0; f=1–4.

22. A bleaching composition according to claim 21, wherein the ligand has the general formula:

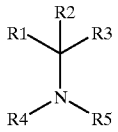

23. A bleaching composition according to claim 22, with the proviso that none of R1 to R3 represents hydrogen.

24. A bleaching composition according to claim 22, wherein the ligand has the general formula:

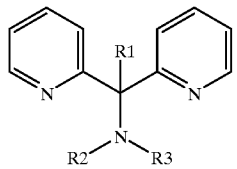

wherein

R1, R2, R3 are as defined for R2, R4, R5.

25. A bleaching composition according to claim 21, wherein in the complex of the general formula (A1):

M=Mn(II)–(IV), Fe(II)–(III), Cu(II), Co(II)–(III);

X=$CH_3CN$, $OH_2$, $Cl^-$, $Br^-$, $OCN^-$, $N_3^-$, $SCN^-$, $OH^-$, $O^{2-}$, $PO_4^{3-}$, $C_6H_5BO_2^{2-}$, $RCOO^-$;

Y=$ClO_4^-$, $BPh_4^-$, $Br^-$, $Cl^-$, $[FeCl_4]^-$, $PF_6^-$, $NO_3^-$;

a=1, 2, 3, 4;

n=0, 1, 2, 3, 4;

m=0, 1, 2, 3, 4, 5, 6, 7, 8; and k=1, 2, 3, 4.

26. A bleaching composition according to claim 1, wherein L represents a pentadentate ligand of the general formula (B):

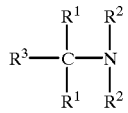

wherein each $R^1$, $R^2$ independently represents —$R^4$—$R^5$, $R^3$ represents hydrogen, optionally substituted alkyl, aryl or arylalkyl, or —$R^4$—$R^5$, each $R^4$ independently represents a single bond or optionally substituted alkylene, alkenylene, oxyalkylene, aminoalkylene, alkylene ether, carboxylic ester or carboxylic amide, and each $R^5$ independently represents an optionally N-substituted aminoalkyl group or an optionally substituted heteroaryl group selected from pyridinyl, pyrazinyl, pyrazolyl, pyrrolyl, imidazolyl, benzimidazolyl, pyrimidinyl, triazolyl and thiazolyl.

27. A bleaching composition according to claim 26, with the proviso that $R^3$ does not represent hydrogen.

28. A bleaching composition according to claim 1, wherein L represents a pentadentate or hexadentate ligand of the general formula (C):

$$R^1R^1N—W—NR^1R^2$$

wherein each $R^1$ independently represents —$R^3$—V, in which $R^3$ represents optionally substituted alkylene, alkenylene, oxyalkylene, aminoalkylene or alkylene ether, and V represents an optionally substituted heteroaryl group selected from pyridinyl, pyrazinyl, pyrazolyl, pyrrolyl, imidazolyl, benzimidazolyl, pyrimidinyl, triazolyl and thiazolyl;

W represents an optionally substituted alkylene bridging group selected from —$CH_2CH_2$—, —$CH_2CH_2CH_2$—, —$CH_2CH_2CH_2CH_2$—, —$CH_2$—$C_6H_4$—$CH_2$—, —$CH_2$—$C_6H_{10}$—$CH_2$—, and —$CH_2$—$C_{10}H_6$—$CH_2$—; and $R^2$ represents a group selected from $R^1$, and alkyl, aryl and arylalkyl groups optionally substituted with a substituent selected from hydroxy, alkoxy, phenoxy, carboxylate, carboxamide, carboxylic ester, sulphonate, amine, alkylamine and $N^+(R^4)_3$, wherein $R^4$ is selected from hydrogen, alkanyl, alkenyl, arylalkanyl, arylalkenyl, oxyalkanyl, oxyalkenyl, aminoalkanyl, aminoalkenyl, alkanyl ether and alkenyl ether.

29. A bleaching composition according to claim 1, wherein L represents a macrocyclic ligand of formula (E):

(E)

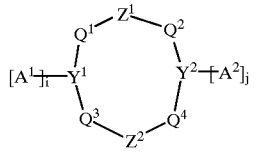

wherein $Z^1$ and $Z^2$ are independently selected from monocyclic or polycyclic aromatic ring structures optionally containing one or more heteroatoms, each aromatic ring structure being substituted by one or more substituents;

$Y^1$ and $Y^2$ are independently selected from C, N, O, Si, P and S atoms;

$A^1$ and $A^2$ are independently selected from hydrogen, alkyl, alkenyl and cycloalkyl (each of alkyl, alkenyl and cycloalkyl) being optionally substituted by one or more groups selected from hydroxy, aryl, heteroaryl, sulphonate, phosphate, electron donating groups and electron withdrawing groups, and groups of formulae $(G^1)(G^2)N$—, $G^3OC(O)$—, $G^3O$— and $G^3C(O)$—, wherein each of $G^1$, $G^2$ and $G^3$ is independently selected from hydrogen and alkyl, and electron donating and/or withdrawing groups (in addition to any amongst the foregoing);

i and j are selected from 0, 1 and 2 to complete the valency of the groups $Y^1$ and $Y^2$;

each of $Q^1$–$Q^4$ is independently selected from groups of formula

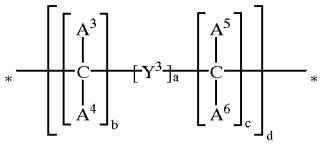

wherein

10>a+b+c+d>2;

each $Y^3$ is independently selected from —O—, —S—, —SO—, —$SO_2$—, —$(G^1)(G^2)N$—, —$(G^1)N$— (wherein $G^1$ and $G^2$ are as hereinbefore defined), —C(O)—, aryl, heteroaryl, —P— and —P(O)—;

each of $A^3$–$A^6$ is independently selected from the groups hereinbefore defined for $A^1$ and $A^2$; and wherein any two or more of $A^1$–$A^6$ together form a bridging group, provided that if $A^1$ and $A^2$ are linked without simultaneous linking also to any of $A^3$–$A^6$, then the bridging group linking $A^1$ and $A^2$ must contain at least one carbonyl group.

30. A bleaching composition according to claim 1, wherein

L represents a ligand of the general formula, or its protonated or deprotonated analogue:

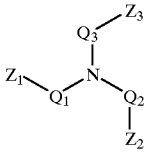

wherein $Z_1$, $Z_2$ and $Z_3$ independently represent a co-ordinating group selected from carboxylate, amido, —NH—C(NH)$NH_2$, hydroxyphenyl, an optionally substituted heterocyclic ring or an optionally substituted heteroaromatic ring selected from pyridine, pyrimidine, pyrazine, pyrazole, imidazole, benzimidazole, quinoline, quinoxaline, triazole, isoquinoline, carbazole, indole, isoindole, oxazole and thiazole;

Q1 Q2 and Q3 independently represent a group of the formula:

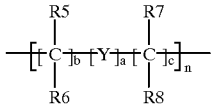

wherein

5≧a+b+c≧1; a=0–5; b=0–5; c=0–5; n=1 or 2;

Y independently represents a group selected from —O—, —S—, —SO—, —$SO_2$—, —C(O)—, arylene, alkylene, heteroarylene, heterocycloalkylene, —(G)P—, —P(O)— and —(G)N—, wherein G is selected from hydrogen, alkyl, aryl, arylalkyl, cycloalkyl, each except hydrogen being optionally substituted by one or more functional groups E;

R5, R6, R7, R8 independently represent a group selected from hydrogen, hydroxyl, halogen, —R and —OR, wherein R represents alkyl, alkenyl, cycloalkyl, heterocycloalkyl, aryl, heteroaryl or a carbonyl derivative group, R being optionally substituted by one or more functional groups E, or R5 together with R6, or R7 together with R8, or both, represent oxygen, or R5 together with R7 and/or independently R6 together with R8, or R5 together with R8 and/or independently R6 together with R7, represent $C_{1-6}$-alkylene optionally substituted by $C_{1-4}$-alkyl, —F, —Cl, —Br or —I; and E independently represents a functional group selected from —F, —Cl, —Br, —I, —OH, —OR', $NH_2$, —NHR', —$N(R')_2$, —$N(R')_3^+$, —C(O)R', —OC(O)R', —COOH, —$COO^-$ ($NA^+$, $K^+$), —COOR', —C(O)$NH_2$, —C(O)NHR', —C(O)$N(R')_2$, heteroaryl, —R', —SR', —SH, —$P(R')_2$, —P(O)$(R')_2$—P(O)$(OH)_2$, —P(O)$(OR')_2$, —$NO_2$, —$SO_3H$, —$SO_3^-$ ($NA^+$, $K^+$) —$S(O)_2R'$, —NHC(O)R', and —N(R')C(O)R', wherein R' represents cycloalkyl, aryl, arylalkyl, or alkyl optionally substituted by —F, —Cl, —Br, —I, —$NH_3^+$, —$SO_3H$, —$SO_3^-$ ($Na^+$,$K^+$) —COOH, —$COO^-$($Na^+$,$K^+$), —P(O)$(OH)_2$, or —P(O)($O^-$($Na^+$, $K^+$))$_2$.

31. A bleaching method comprising the steps a) loading articles, preferably garments, in a vessel;

b) contacting the items with a bleaching composition according to claim 1.

32. A bleaching method according to claim 31 whereby the complex catalyses bleaching of the textile by atmospheric oxygen after the treatment.

33. A bleaching method according to claim 32 whereby the composition is substantially devoid of peroxygen bleach or a peroxy-based or -generating bleach system.

34. A method of preparing a bleaching composition according to claim 1 comprising the step of dissolving or dispersing the organic substance in a compatible solvent prior to mixing the organic substance with the carbon dioxide.

* * * * *